US011747744B2

(12) United States Patent
Iwasaki et al.

(10) Patent No.: US 11,747,744 B2
(45) **Date of Patent: *Sep. 5, 2023**

(54) ELECTROSTATIC CHARGE IMAGE DEVELOPING CARRIER, ELECTROSTATIC CHARGE IMAGE DEVELOPER, AND IMAGE FORMING APPARATUS

(71) Applicant: FUJIFILM Business Innovation Corp., Tokyo (JP)

(72) Inventors: Jumpei Iwasaki, Minamiashigara (JP); Yasuo Kadokura, Minamiashigara (JP); Shintaro Anno, Minamiashigara (JP); Kazutsuna Sasaki, Minamiashigara (JP); Satoshi Miura, Minamiashigara (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/944,975

(22) Filed: Jul. 31, 2020

(65) Prior Publication Data

US 2021/0278773 A1 Sep. 9, 2021

(30) Foreign Application Priority Data

Feb. 28, 2020 (JP) ..... 2020-034173
Feb. 28, 2020 (JP) ..... 2020-034174
Feb. 28, 2020 (JP) ..... 2020-034176

(51) Int. Cl.
*G03G 9/083* (2006.01)
*G03G 9/097* (2006.01)
(Continued)

(52) U.S. Cl.
CPC ..... *G03G 9/0839* (2013.01); *G03G 9/0819* (2013.01); *G03G 9/0825* (2013.01);
(Continued)

(58) Field of Classification Search
CPC .. G03G 9/1075; G03G 9/0839; G03G 9/1131; G03G 9/0819; G03G 9/0825; G03G 9/08755; G03G 9/09725
(Continued)

(56) References Cited

U.S. PATENT DOCUMENTS 5,663,027 A * 9/1997 Kohri ..... G03G 9/10884 430/111.4
6,406,826 B1 6/2002 Suzuki et al.
(Continued)

FOREIGN PATENT DOCUMENTS

JP 2001-188388 A 7/2001
JP 3942139 B2 7/2007
(Continued)

*Primary Examiner* — Peter L Vajda
*Assistant Examiner* — Boone Alexander Evans
(74) *Attorney, Agent, or Firm* — Sughrue Mion, PLLC

(57) ABSTRACT

An electrostatic charge image developing carrier includes: magnetic particles; and a resin layer coating the magnetic particles and containing inorganic particles, in which an average particle diameter of the inorganic particles is 5 nm or more and 90 nm or less, an average thickness of the resin layer is 0.6 μm or more and 1.4 μm or less, and a ratio B/A of a surface area B of the electrostatic charge image developing carrier to a plan view area A of the electrostatic charge image developing carrier is 1.020 or more and 1.100 or less when a surface of the electrostatic charge image developing carrier is three-dimensionally analyzed.

16 Claims, 2 Drawing Sheets

(51) Int. Cl.
*G03G 15/08* (2006.01)
*G03G 9/08* (2006.01)
*G03G 9/087* (2006.01)

(52) U.S. Cl.
CPC ..... *G03G 9/08755* (2013.01); *G03G 9/09725* (2013.01); *G03G 15/08* (2013.01)

(58) Field of Classification Search
USPC ..... 430/111.35
See application file for complete search history.

(56) References Cited

U.S. PATENT DOCUMENTS

| | | | | |
|---|---|---|---|---|
| 8,728,697 | B2 | 5/2014 | Ishizuka | |
| 9,726,998 | B1 * | 8/2017 | Morooka | G03G 9/1139 |
| 2011/0217643 | A1 | 9/2011 | Ishizuka | |
| 2013/0065175 | A1 | 3/2013 | Sakata et al. | |
| 2016/0166512 | A1 * | 6/2016 | Sirkar | A61K 9/5089 427/2.14 |
| 2016/0309091 | A1 | 10/2016 | Kigure et al. | |
| 2018/0067414 | A1 | 3/2018 | Murakami et al. | |
| 2018/0113392 | A1 | 4/2018 | Iwase et al. | |
| 2018/0113393 | A1 | 4/2018 | Seki et al. | |
| 2018/0143557 | A1 * | 5/2018 | Ueda | G03G 9/0821 |

FOREIGN PATENT DOCUMENTS

| | | | |
|---|---|---|---|
| JP | 2011-186005 | A | 9/2011 |
| JP | 2013-061511 | A | 4/2013 |
| JP | 5540775 | B2 | 7/2014 |
| JP | 2016-175018 | A | 10/2016 |
| JP | 2016-206250 | A | 12/2016 |
| JP | 2018-040952 | A | 3/2018 |
| JP | 2018-066892 | A | 4/2018 |
| JP | 2018-066903 | A | 4/2018 |

* cited by examiner

ELECTROSTATIC CHARGE IMAGE DEVELOPING CARRIER, ELECTROSTATIC CHARGE IMAGE DEVELOPER, AND IMAGE FORMING APPARATUS

CROSS-REFERENCE TO RELATED APPLICATIONS

This application is based on and claims priorities under 35 USC 119 from Japanese Patent Application No. 2020-034173 filed on Feb. 28, 2020, Japanese Patent Application No. 2020-034174 filed on Feb. 28, 2020, and Japanese Patent Application No. 2020-034176 filed on Feb. 28, 2020.

BACKGROUND

Technical Field

The present invention relates to an electrostatic charge image developing carrier, an electrostatic charge image developer, and an image forming apparatus.

Related Art

Patent Literature 1 discloses a carrier for electrostatic latent image developer containing magnetic core material particles and a coating layer coating the surface of the core material particles, in which the coating layer contains two or more types of inorganic fine particles, at least one of the two or more types of inorganic fine particles are inorganic fine particles A having conductivity and having a peak particle diameter of 300 nm to 1000 nm, and (BET specific surface area of carrier—BET specific surface area of core material particles) is 1.10 $m^2/g$ to 1.90 $m^2/g$.

Patent Literature 2 discloses an electrostatic latent image developing carrier which is a carrier for electrostatic charge image developer including a coating layer containing a binder resin and fine particles on a core material, in which an area ratio of the exposed core material on the surface of carrier particles is 0.1% or more and 5.0% or less, a maximum exposed area of the exposed core material is 0.03% or less of the surface area of the core material, and the fine particles are contained in 100 parts by weight or more and 500 parts by weight or less based on 100 parts by weight of the binder resin.

Patent Literature 3 discloses an electrophotographic carrier including a coating film containing a binder resin and particles, in which a specific resistance of the particles is $10^{12}$ Ω·cm or more, and a particle diameter D and a film thickness of the binder resin satisfy $1<D/h<5$.

Patent Literature 1: JP-A-2018-066892
Patent Literature 2: JP-A-2013-061511
Patent Literature 3: JP-A-2001-188388

SUMMARY

Aspects of certain non-limiting embodiments of the present disclosure relate to an electrostatic charge image developing carrier which contains magnetic particles and a resin layer coating the magnetic particles and containing inorganic particles and prevents a toner from blowing out, as compared with an electrostatic charge image developing carrier in which an average particle diameter of the inorganic particles is less than 5 nm or more than 90 nm, or an electrostatic charge image developing carrier in which an average thickness of the resin layer is less than 0.6 μm or more than 1.4 μm or an electrostatic charge image developing carrier in which a ratio B/A of a surface area B of the electrostatic charge image developing carrier to a plan view area A of the electrostatic charge image developing carrier is less than 1.020 or more than 1.100 when a surface of the electrostatic charge image developing carrier is three-dimensionally analyzed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrostatic charge image developing carrier containing: magnetic particles; and a resin layer coating the magnetic particles and containing inorganic particles, in which an average particle diameter of the inorganic particles is 5 nm or more and 90 nm or less, an average thickness of the resin layer is 0.6 μm or more and 1.4 μm or less, and a ratio B/A of a surface area B the of electrostatic charge image developing carrier to a plan view area A of the electrostatic charge image developing carrier is 1.020 or more and 1.100 or less when a surface of the electrostatic charge image developing carrier is three-dimensionally analyzed.

BRIEF DESCRIPTION OF THE DRAWINGS

Exemplary embodiment(s) of the present invention will be described in detail based on the following figures, wherein.

Figure 1:
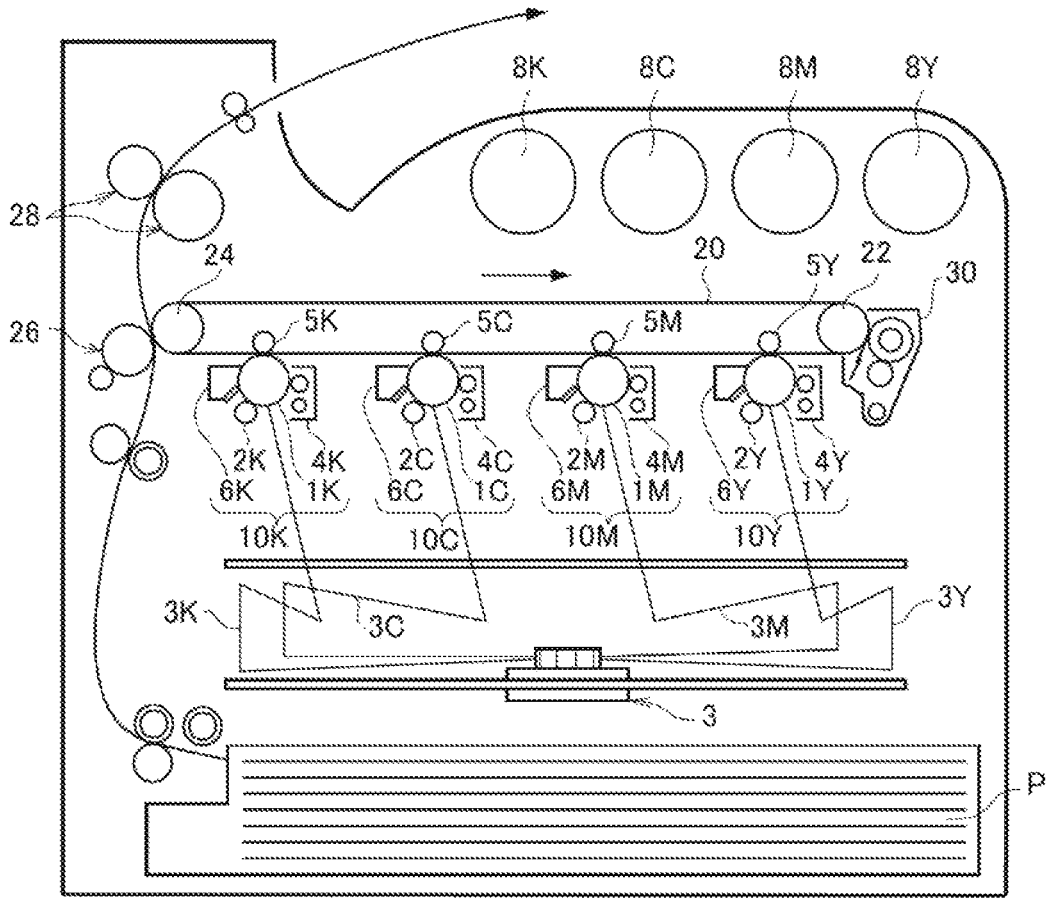
FIG. 1 is a schematic configuration diagram illustrating an example of an image forming apparatus according to the exemplary embodiment.
Figure 2:
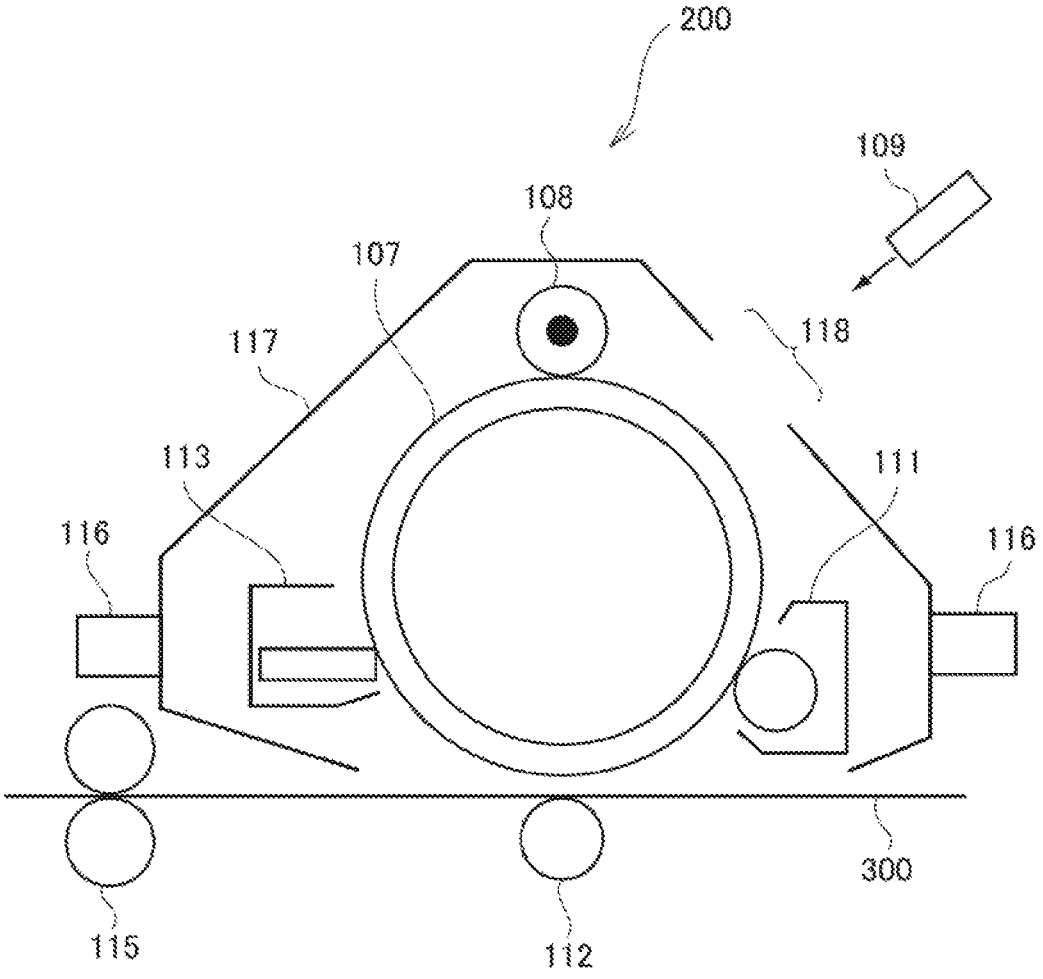
FIG. 2 is a schematic configuration diagram illustrating an example of a process cartridge that is attached to and detached from an image forming apparatus according to the exemplary embodiment.

Reference numbers and signs in FIG. 1 and FIG. 2 are described below.

- 1Y, 1M, 1C, 1K: photoconductor (an example of image carrier)
- 2Y, 2M, 2C, 2K: charging roller (an example of charging unit)
- 3: exposure device (an example of electrostatic charge image forming unit)
- 3Y, 3M, 3C, 3K: laser beam
- 4Y, 4M, 4C, 4K: developing device (an example of developing unit)
- 5Y, 5M, 5C, 5K: primary transfer roller (an example of primary transfer unit)
- 6Y, 6M, 6C, 6K: photoconductor cleaning device (an example of cleaning nit)
- 8Y, 8M, 8C, 8K: toner cartridge
- 10Y, 10M, 10C, 10K: image forming unit
- 20: intermediate transfer belt (an example of intermediate transfer body)
- 22: drive roller
- 24: support roller
- 26: secondary transfer roller (an example of secondary transfer unit)
- 28: fixing device (an example of fixing unit)
- 30: intermediate transfer body cleaning device
- P: recording paper (an example of recording medium)
- 107: photoconductor (an example of image carrier)
- 108: charging roller (an example of charging unit)

109: exposure device (an example of electrostatic charge image forming unit)
111: developing device (an example of developing unit)
112: transfer device (an example of transfer unit)
113: photoconductor cleaning device (an example of cleaning unit)
115: fixing device (an example of fixing unit)
116: mounting rail
117: housing
118: opening for exposure
200: process cartridge
300: recording paper (an example of recording medium)

DETAILED DESCRIPTION

Hereinafter, exemplary embodiments of the present disclosure will be described. These descriptions and Examples illustrate the exemplary embodiment, and do not limit the scope of the exemplary embodiment.

In the present disclosure, a numerical range indicated by "to" indicates a range including the numerical values before and after "to" as a minimum value and a maximum value, respectively.

In the numerical ranges described in stages in the present disclosure, an upper limit or a lower limit described in one numerical range may be replaced with an upper limit or a lower limit of the numerical range described in other stages. Further, in the numerical ranges described in the present disclosure, the upper limit or the lower limit of the numerical range may be replaced with values shown in Examples.

In the present disclosure, the term "step" indicates not only an independent step, and even when a step are not clearly distinguished from other steps, this step is included in the term "step" as long as the intended purpose of the step is achieved.

When an exemplary embodiment is described in the present disclosure with reference to the drawings, the configuration of the exemplary embodiment is not limited to the configuration illustrated in the drawings. In addition, the sizes of the members in each drawing are conceptual, and the relative size relationship between the members is not limited to this.

In the present disclosure, each component may include a plurality of corresponding substances. In the present disclosure, in a case of referring to the amount of each component in the composition, when there are a plurality of substances corresponding to each component in the composition, unless otherwise specified, it refers to the total amount of the plurality of substances present in the composition.

In the present disclosure, each component may include a plurality of corresponding particles. When there are a plurality of types of particles corresponding to each component in the composition, unless otherwise specified, the particle diameter of each component means a value for a mixture of the plurality of types of particles present in the composition.

In the present disclosure, the term "(meth)acryl" means at least one of acryl and methacryl, and the term "(meth) acrylate" means at least one of acrylate and methacrylate.

In the present disclosure, the term "electrostatic charge image developing toner" is also referred to as "toner" the term "electrostatic charge image developing carrier" is also referred to as "carrier", and the term "electrostatic charge image developer" is also referred to as "developer".

<Electrostatic Charge Image Developing Carrier>

The carrier according to the exemplary embodiment is a resin-coated carrier which contains magnetic particles and a resin layer coating the magnetic particles and containing inorganic particles.

In the carrier according to the exemplary embodiment, an average particle diameter of the inorganic particles contained in the resin layer is 5 nm or more and 90 nm or less, an average thickness of the resin layer is 0.6 μm or more and 1.4 μm or less, and a ratio B/A of a surface area B to a plan view area A is 1.020 or more and 1.100 or less when a surface thereof is three-dimensionally analyzed.

In the exemplary embodiment, carbon black shall not be inorganic particles.

In the exemplary embodiment, the average particle diameter of the inorganic particles contained in the resin layer and the average thickness of the resin layer are determined by the following method.

The carrier is embedded in an epoxy resin and cut with a microtome to prepare a carrier cross section. An SEM image of the carrier cross section taken by a scanning electron microscope (SEM) is taken into an image processing analysis device to perform image analysis. 100 inorganic particles (primary particles) in the resin layer are randomly selected, a circle-equivalent diameter (nm) of each particle is determined, and the circle-equivalent diameters are arithmetically averaged to obtain the average particle diameter (nm) of the inorganic particles. The thickness (μm) of the resin layer is measured by randomly selecting 10 points per one particle of the carrier, 100 carriers are farther measured, and the thicknesses are arithmetically averaged to obtain the average thickness (μm) of the resin layer.

In the exemplary embodiment, the ratio B/A is an index for evaluating surface roughness. The ratio B/A is obtained by, for example, the following method.

As a device for three-dimensionally analyzing the surface of the carrier, a scanning electron microscope including four secondary electron detectors (e.g., electron beam three-dimensional roughness analyzer ERA-8900FE manufactured by Elionix Inc.) is used and the analysis is performed as follows. The surface of one carrier particle is magnified 5000 times. The distance between measurement points is set to 0.06 μm, the measurement points are 400 points in the long side direction and 300 points in the short side direction, and a region of 24 μm×18 μm is measured to obtain three-dimensional image data.

For the three-dimensional image data, a limit wavelength of a spline filter, which is a frequency selection filter using a spline function, is set to 12 μm to remove wavelengths having a period of 12 μm or more. As a result, a waviness component on the carrier surface is removed and a roughness component is extracted to obtain a roughness curve.

Further, a cutoff vale of a Gaussian high-pass filter, which is a frequency selection filter using a Gaussian function, is set to 2.0 μm to remove wavelengths having a period of 2.0 μm or more. As a result, the wavelength corresponding to convex portions of the magnetic particles exposed on the carrier surface is removed from the roughness curve after spline filter processing, and a roughness curve in which the wavelength component having a period of 2.0 μm or more is removed is obtained.

From the three-dimensional roughness curve data after the filter processing, the surface area B ($\mu m^2$) of a central region of 12 μm×12 μm (plan view area A=144 $\mu m^2$) is obtained to obtain the ratio BA. The ratio B/A is calculated for 100 carriers and arithmetically averaged.

The carrier according to the exemplary embodiment prevents the toner from blowing out. The mechanism is presumed as follows.

When the toner is continuously stirred in a developing unit, the toner may aggregate and the apparent toner particle diameter may increase. As a result, a charge fluctuation may occur, and the toner may blow out of the developing unit. This phenomenon is likely to occur when images having a relatively low image density are continuously formed on a recording medium having a relatively small area, and thereafter images having a relatively high image density are formed.

In contrast, it is presumed that the carrier, in which the average particle diameter of the inorganic particles in the resin layer, the average thickness of the resin layer, and the ratio B/A are in the above ranges, is less likely to cause toner aggregation in the developing unit due to the following reasons (a) to (c), and as a result, the toner is prevented from being blown out.

(a) When the average particle diameter of the inorganic particles in the resin layer is less than 5 nm, it is difficult to obtain a filler effect of increasing the strength of the resin layer, and the resin layer is likely to be peeled off when image formation is repeated. When the average particle diameter of the inorganic particles in the resin layer is more than 90 nm, the inorganic particles are likely to be detached from the convex portions of the resin layer, and the resin layer is likely to be peeled off when image formation is repeated. It is presumed that, in either case, the exposed area of the magnetic particles increases on the carrier surface, the mechanical stress on the toner increases, and a toner external additive is embedded in the toner particles, resulting in toner aggregation.

From the above viewpoints, the average particle diameter of the inorganic particles in the resin layer is 5 nm or more and 90 nm or less, preferably 5 nm or more and 70 nm or less, more preferably 5 nm or more and 50 nm or less, and still more preferably 8 nm or more and 50 nm or less.

The average particle diameter of the inorganic particles contained in the resin layer may be controlled by using the size of the inorganic particles used for forming the resin layer.

(b) It is presumed that, when the average thickness of the resin layer is less than 0.6 μm, the resin layer is likely to be peeled off when image formation is repeated, the exposed area of the magnetic particles increases on the carrier surface, the mechanical stress on the toner increases, and the toner external additive is embedded in the toner particles, resulting in toner aggregation. It is presumed that, when the average thickness of the resin layer is more than 1.4 μm, the toner external additive migrates to the resin layer and then easily adheres to or is embedded in the resin layer, and the amount of the external additive migrated from the toner to the carrier increases, resulting in toner aggregation.

From the above viewpoints, the average thickness of the resin layer is 0.6 μm or more and 1.4 μm or less, preferably 0.8 nm or more and 1.2 μm or less, and more preferably 0.8 μm or more and 1.1 μm or less.

The average thickness of the resin layer may be controlled by using the amount of the resin used for forming the resin layer, and the larger the amount of the resin with respect to the amount of the magnetic particles is, the larger the average thickness of the resin layer is.

(c) It is presumed that, when the ratio B/A is less than 1.020, the carrier surface is too flat, the contact between the carrier and the toner becomes surface contact, the mechanical stress on the toner increases, and the toner external additive is embedded in the toner particles, resulting in toner aggregation. It is presumed that, when the ratio B/A is more than 1.100, the number of irregularities on the carrier surface is relatively large or a height difference of the irregularities on the carrier surface is relatively large, so that the amount of the toner external additive getting into concave portions on the carrier surface increases, and the amount of the external additive migrated from the toner to the carrier increases, resulting in toner aggregation.

From the above viewpoints, the ratio B/A is 1.020 or more and 1.100 or less, preferably 1.040 or more and 1.080 or less, and more preferably 1.040 or more and 1.070 or less.

The ratio B/A may be controlled by using production conditions for forming the resin layer. Details will be described later.

When the carrier according to the exemplary embodiment has a ratio B/A of 1.020 or more and 1.100 or less, there is a tendency to prevent a decrease in transferability of the toner image when image formation is repeated for a long period of time. In the carrier according to the exemplary embodiment, the resin layer contains inorganic particles, and fine irregularities are appropriately present on the carrier surface. It is presumed that most of the irregularities are coated with the resin but some of the inorganic particles are exposed. Unlike the resin, the exposed inorganic particles are not charged by the contact with the toner, and therefore excessive charging of the carrier surface may be prevented. In addition, when the resin layer of the carrier is abraded by repeating image formation, the irregularities are selectively abraded and some of the inorganic particles in the resin layer are newly exposed. It is presumed that, when some of the inorganic particles exposed on the carrier surface continue to be appropriately exposed on the carrier surface, the chargeability of the carrier surface is reduced, an increase in toner charging is prevented, and as a result, good transferability of the toner image is maintained. This phenomenon is remarkable when the image formation is repeated on embossed paper in a low-temperature and low-humidity environment (e.g., a temperature of 10° C. and a relative humidity of 15%).

From the viewpoint of preventing a decrease in the transferability of the toner image when image formation is repeated for a long period of time, it is preferable that the carrier according to the exemplary embodiment contains silica particles in the resin layer, and the silicon element concentration on the carrier surface is more than 2 atomic % and less than 20 atomic %, as determined by X-ray photoelectron spectroscopy.

A silicon element concentration of more than 2 atomic % means that the silica particles are appropriately distributed on the surface of the resin layer, and therefore the chargeability of the carrier surface is appropriately reduced.

A silicon element concentration of less than 20 atonic % means that the amount of the silica particles distributed on the surface of the resin layer is not too large, and therefore the chargeability of the carrier surface is not excessively reduced.

From the above viewpoints, the silicon element concentration is more preferably more than 5 atomic % and less than 20 atomic %, and still more preferably more than 6 atomic % and less than 19 atomic %.

The silicon element concentration on the carrier surface may be controlled by using the amount of the silica particles used for forming the resin layer, and the higher the amount of the silica particles with respect to the amount of the resin is, the higher the silicon element concentration on the carrier surface is.

From the viewpoint of preventing a decrease in image density when image formation is repeated, in the carrier according to the exemplary embodiment, the average thickness of the resin layer is preferably 0.6 μm or more and 1.4 μm or less. When the average thickness of the resin layer is 0.6 μm or more, the resin layer is less likely to be peeled off when the image formation is repeated, and thus the exposed area ratio of the magnetic particles is maintained. When the average thickness of the resin layer is 1.4 μm or less, fine irregularities are likely to be formed on the carrier surface by the inorganic particles in the resin layer, and the ratio B/A may be easily controlled within the above range.

From the above viewpoints, the average thickness of the resin layer is more preferably 0.8 μm or more and 1.2 μm or less, and still more preferably 0.8 μm or more and 1.1 μm or less.

The average thickness of the resin layer may be controlled by using the amount of the resin used for forming the resin layer, and the larger the amount of the resin with respect to the amount of the magnetic particles is, the larger the average thickness of the resin layer is.

Hereinafter, the configuration of the carrier according to the exemplary embodiment will be described in detail.

[Magnetic Particles]

The magnetic particles are not particularly limited and known magnetic particles used as a core material of the carrier are applied. Specific examples of the magnetic particles include: particles of magnetic metals such as iron, nickel and cobalt; particles of magnetic oxides such as ferrite and magnetite; resin-impregnated magnetic particles obtained by impregnating porous magnetic powder with a resin; and magnetic powder-dispersed resin particles prepared by dispersing magnetic powder in a resin. In the exemplary embodiment, the magnetic particles are preferably ferrite particles.

The volume average particle diameter of the magnetic particles is preferably 15 μm or more and 100 μm or less, more preferably 20 μm or more and 80 μm or less, and still more preferably 30 μm or more and 60 μm or less.

Here, the volume average particle diameter means a particle diameter D), corresponding to the cumulative percentage of 50% in a particle diameter distribution by volume drawn from the side of the small diameter.

The arithmetic average height Ra according to JIS B0601: 2001 of a roughness curve of the magnetic particles is preferably 0.1 μm or more and 1 μm less, and more preferably 0.2 μm or more and 0.8 μm or less.

The arithmetic average height Ra of the roughness curve of the magnetic particles is obtained by observing the magnetic particles at an appropriate magnification (e.g., a magnification of 1000 times) using a surface profile measurement device (e.g., "Ultra-deep color 3D shape measurement microscope VK-9700" manufactured by Keyence Corporation), obtaining a roughness curve at a cutoff value of 0.08 mm, and extracting, from the roughness curve, a reference length of 10 μm in the direction of the average line. The arithmetic average heights Ra of 100 magnetic particles are arithmetically averaged.

As for the magnetic force of the magnetic particles, the saturation magnetization in a magnetic field of 3000 Oersted is preferably 50 emu/g or more, and more preferably 60 emu/g or more. The measurement of the saturation magnetization is performed by using a vibrating sample magnetic measurement device VSMP10-15 (manufactured by Toei Industry Co. Ltd.). The measurement sample is packed in a cell having an inner diameter of 7 mm and a height of 5 mm and set in the above device. The measurement is performed by applying a magnetic field and sweeping up to 3000 Oersted in the maximum. Then, the applied magnetic field is reduced to create a hysteresis curve on a recording paper. The saturation magnetization, the residual magnetization, and the coercive force are determined from data of the curve.

The volume electric resistance (volume resistivity) of the magnetic particles is preferably $1\times10^5$ Ω·cm or more and $1\times10^9$ Ω·cm or less, and more preferably $1\times10^7$ Ω·cm or more and $1\times10^9$ Ω·cm or less.

The volume electric resistance (Ω·cm) of the magnetic particles is measured as follows. Measurement targets are placed flat on a surface of a circular jig, on which an electrode plate having 20 $cm^2$ is arranged, so as to have a thickness of 1 mm or more and 3 mm or less to form a layer. The electrode plate having 20 $cm^2$ is placed thereon to sandwich the layer. In order to eliminate a void between the measurement targets, a load of 4 kg is applied on the electrode plate arranged on the layer, and then the layer thickness (cm) is measured. The two electrodes above and below the layer are connected to an electrometer and a high voltage power supply generator. A high voltage is applied to the two electrodes to cause an electric field of 103.8 V/cm, and a current value (A) flowing at this time is read. The measurement environment is a temperature of 20° C. and a relative humidity of 50%. The calculation equation for the volume electric resistance (Ω·cm) of the measurement target is as shown in the following equation.

$$R=E\times20/(I-I_0)/L$$

In the above equation, R represents the volume electric resistance (Ω·cm) of the measurement target, E represents an applied voltage (V), I represents the current value (A), $I_0$ represents a current value (A) at the applied voltage of 0 V, and L represents the layer thickness (cm), respectively. The coefficient 20 represents an area ($cm^2$) of the electrode plate.

[Resin Layer]

Examples of the resin forming the resin layer include: a styrene-acrylic acid copolymer; polyolefin resins such as polyethylene and polypropylene; polyvinyl or polyvinylidene resins such as polystyrene, an acrylic resin, polyacrylonitrile, polyvinyl acetate, polyvinyl alcohol, polyvinyl butyral, polyvinyl chloride, polyvinyl carbazole, polyvinyl ether, and polyvinyl ketone; a vinyl chloride-vinyl acetate copolymer; a straight silicone resin having an organosiloxane bond or a modified product thereof; fluororesins such as polytetrafluoroethylene, polyvinyl fluoride, polyvinylidene fluoride, and polychlorotrifluoroethylene; polyester; polyurethane; polycarbonate; amino resins such as a urea-formaldehyde resin; and epoxy resins.

The resin layer preferably contains an acrylic resin having an alicyclic structure. A polymerization component of the acrylic resin having an alicyclic structure is preferably a lower alkyl ester of (meth)acrylic acid (e.g., alkyl (meth) acrylate containing an alkyl group having 1 or more and 9 or less carbon atoms), and specific examples thereof include methyl (meth)acrylate, ethyl (meth)acrylate, propyl (meth) acrylate, butyl (meth)acrylate, hexyl (meth)acrylate, cyclohexyl (meth)acrylate, and 2-ethylhexyl (meth)acrylate. These monomers may be used alone or in combination of two or more thereof.

The acrylic resin having an alicyclic structure preferably contains cyclohexyl (meth)acrylate as a polymerization component. The content of monomer units derived from cyclohexyl (meth)acrylate contained in the acrylic resin having an alicyclic structure is preferably 75 mass % or more and 100 mass % or less, more preferably 85 mass % or more and 100 mass % or less, and still more preferably 95 mass % or more and 100 mass % or less, based on the total mass of the acrylic resin having an alicyclic structure.

Examples of the inorganic particles contained in the resin layer include: particles of metal oxides such as silica, titanium oxide, zinc oxide, and tin oxide; particles of metal compounds such as barium sulfate, aluminum borate, and potassium titanate; and particles of metals such as gold, silver, and copper. Among these, silica particles are preferred from the viewpoints of preventing the toner from blowing out and maintaining the transferability of the toner image.

The surface of the inorganic particles may be subjected to a hydrophobic treatment. Examples of a hydrophobic treatment agent include known organosilicon compounds having an alkyl group (e.g., a methyl group, an ethyl group, a propyl group, and a butyl group), and specific examples thereof include an alkoxysilane compound, a siloxane compound, and a silazane compound. Among these, the hydrophobic treatment agent is preferably a silazane compound, and more preferably hexamethyldisilazane. The hydrophobic treatment agent may be used alone or in combination of two or more thereof.

Examples of a method of subjecting the inorganic particles to a hydrophobic treatment with a hydrophobic treatment agent include: a method of dissolving a hydrophobic treatment agent in supercritical carbon dioxide by using supercritical carbon dioxide and adhering the hydrophobic treatment agent to the surface of the inorganic particles; a method of applying (e.g., spraying or coating) a solution containing a hydrophobic treatment agent and a solvent that dissolves the hydrophobic treatment agent to the surface of the inorganic particles in the atmosphere and adhering the hydrophobic treatment agent to the surfaces of the inorganic particles; and a method of adding a solution containing a hydrophobic treatment agent and a solvent that dissolves the hydrophobic treatment agent to an inorganic particle dispersion liquid and holding the mixed solution in the atmosphere, and then drying the mixed solution containing the inorganic particle dispersion liquid and the solution.

The content of the inorganic particles contained in the resin layer is preferably 10 mass % or more and 60 mass % or less, more preferably 15 mass % or more and 55 mass % or less, and still more preferably 20 mass % or more and 50 mass % or less, based on the total mass of the resin layer.

The content of the silica particles contained in the resin layer is preferably 10 mass % or more and 60 mass % or less, more preferably 15 mass % or more and 55 mass % or less, and still more preferably 20 mass % or more and 50 mass % or less, based on the total mass of the resin layer.

The resin layer may contain conductive particles for the purpose of controlling charging and resistance. Examples of the conductive particles include carbon black and particles having conductivity among the above-mentioned inorganic particles.

Examples of a method of forming the resin layer on the surface of the magnetic particles include a wet production method and a dry production method. The wet production method is a production method using a solvent that dissolves or disperses the resin forming the resin layer. On the other hand, the dry production method is a production method which does not use the solvent.

Examples of the wet production method include: an immersion method of coating immersing magnetic particles in a resin layer forming resin liquid; a spray method of spraying a resin layer forming resin liquid onto the surface of magnetic particles; a fluidized bed method of spraying a resin layer forming resin liquid with magnetic particles fluidized in a fluidized bed; and a kneader coater method of mixing magnetic particles and a resin layer forming resin liquid in a kneader coater and removing a solvent. These production methods may be repeated or combined.

The resin layer forming resin liquid for use in the wet production method is prepared by dissolving or dispersing a resin, inorganic particles and other components in a solvent. The solvent is not particularly limited and examples thereof include: aromatic hydrocarbons such as toluene and xylene; ketones such as acetone and methyl ethyl ketone; and ethers such as tetrahydrofuran and dioxane.

Examples of the dry production method include a method of heating a mixture of magnetic particles and a resin layer forming resin in a dry state to firm a resin layer. Specifically, for example, magnetic particles and a resin layer forming resin are mixed in a gas phase and heated and melted to form a resin layer.

The ratio B/A may be controlled by the production conditions.

For example, in a production method of repeating a kneader coater method plural times (e.g., twice) to form a resin layer stepwise, in the final kneader coater step, the mixing time of the particles to be coated and the resin layer forming resin liquid is adjusted to control the ratio B/A. The longer the mixing time of the final kneader coater step is, the smaller the ratio B/A tends to be.

For another example, in a production method of applying, by a spray method, a liquid composition containing inorganic particles, which may or may not contain a resin, to the surface of the resin-coated carrier produced by the kneader coater method, the particle diameter and the content of the inorganic particles contained in the liquid composition or the amount of the liquid composition applied to the resin-coated carrier is adjusted to control the ratio B/A.

The exposed area ratio of the magnetic particles on the carrier surface is preferably 5% or more and 30% or less, more preferably 7% or more and 25% or less, and still more 10% or more and 25% or less. The exposed area ratio of the magnetic particles on the carrier surface may be controlled by the amount of the resin used for forming the resin layer, and the larger the amount of the resin with respect to the amount of the magnetic particles is, the smaller the exposed area ratio is.

The exposed area ratio of the magnetic particles on the carrier surface is a value obtained by the following method.

A target carrier and magnetic particles obtained by removing the resin layer from the target carrier are prepared. Examples of a method of removing the resin layer from the carrier include a method of removing a resin layer by dissolving a resin component with an organic solvent, and a method of removing a resin layer by heating to eliminate a resin component at about 800° C. The carrier and the magnetic particles are used as measurement samples, the Fe concentrations (atomic %) on the surfaces of the samples are quantified by XPS, and (Fe concentration of carrier)/(Fe concentration of magnetic particles)×100 is calculated to be the exposed area ratio (%) of the magnetic particles.

The volume average particle diameter of the carrier is preferably 10 μm or more and 120 μm or less, more preferably 20 μm or more and 100 μm or less, and still more preferably 30 μm or more and 80 μm or less.

Here, the volume average particle diameter means a particle diameter $D_{50v}$ corresponding to the cumulative percentage of 50% in a particle diameter distribution by volume drawn from the side of the small diameter.

<Electrostatic Charge Image Developer>

The developer according to the exemplary embodiment is a two-component developer containing the carrier according to the exemplary embodiment and a toner. The toner contains toner particles and, if necessary, an external additive.

The mixing ratio (mass ratio) of the carrier and the toner in the developer is preferably carrier:toner=100:1 to 100:30, and more preferably 100:3 to 100:20.

[Toner Particles]

The toner particles contain, for example, a binder resin, and if necessary, a colorant, release agent, and other additives.

—Binder Resin—

Examples of the binder resin include vinyl-based resins obtained from a homopolymer of monomers such as styrenes (such as styrene, parachlorostyrene, and α-methylstyrene), (meth)acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene), or a copolymer combining two or more of these monomers.

Examples of the binder resin also include non-vinyl-based resins such as an epoxy resin, a polyester resin, a polyurethane resin, a polyamide resin, a cellulose resin, a polyether resin, and a modified rosin, a mixture of these non-vinyl-based resins and the vinyl-based resins, or a graft polymer obtained by polymerizing a vinyl-based monomer in the coexistence of these non-vinyl-based resins.

These binder resins may be used alone or in combination of two or more thereof.

The binder resin is preferably a polyester resin.

Examples of the polyester resin include known amorphous polyester resins. As the polyester resin, a crystalline polyester resin may be used in combination with the amorphous polyester resin. However, the content of the crystalline polyester resin is preferably 2 mass % or more and 40 mass % or less, and more preferably 2 mass % or more and 20 mass % or less, based on the entire binder resin.

The "crystalline" of a resin refers to having a clear endothermic peak in differential scanning calorimetry (DSC), not a stepwise change in endothermic amount, and specifically refers to that the half-value width of the endothermic peak when measured at a temperature rising rate of 10 (° C./min) is within 10° C.

On the other hand, the "amorphous" of the resin refers to that the half-value width is larger than 10° C., that the endothermic amount changes stepwise, or that no clear endothermic peak is observed.

The binder resin is not limited to the polyester resin, and preferably includes a crystalline resin.

The crystalline resin is not particularly limited, and examples thereof include known resins such as a crystalline polyester resin, a crystalline vinyl resin (e.g., a polyalkylene resin and a long-chain alkyl (meth)acrylate resin), a crystalline epoxy resin, a crystalline polyurethane resin, a crystalline cellulose resin, a crystalline polyamide resin, and a modified rosin.

Among these, the binder resin preferably contains a crystalline polyester resin as the crystalline resin.

The melting point of the crystalline resin is, for example, preferably in the range of 65° C. or higher and 90° C. or lower, more preferably in the range of 70° C. or higher and 85° C. or lower, and still more preferably in the range of 70° C. or higher and 80° C. or lower.

When the melting point of the crystalline resin is 90° C. or lower, the low temperature fixability of the toner is easily obtained. On the other hand, when the melting point of the crystalline resin is low, the surface of the toner particles is likely to be soft, while the inclusion of the carrier prevents the embedding of the external additive and prevents gloss unevenness of the image. When the melting point of the crystalline resin is 65° C. or higher, the surface of the toner particles does not become too soft as compared with the case of lower than 65° C., the embedding of the external additive is likely to be prevented, and the gloss unevenness of the image is prevented. That is, when the melting point of the crystalline resin is 65° C. or higher and 90° C. or lower, both the low temperature fixability and the prevention of the gloss unevenness of the image are achieved.

The melting point of the crystalline resin is obtained from the DSC curve obtained by differential scanning calorimetry (DSC) according to the "melting peak temperature" described in JIS K 7121-1987 "Method for measuring transition temperature of plastics", which is a method for obtaining the melting temperature.

The content of the crystalline resin is preferably 5 mass % or more and 30 mass % or less, more Preferably 5 mass % or more and 25 mass % or less, and still more preferably 5 mass % or more and 20 mass % or less, based on the total toner particles, from the viewpoint of achieving both the ow temperature fixability of the toner and the prevention of the gloss unevenness of the image.

In addition, the content of the crystalline resin is preferably 3 mass % or more and 25 mass % or less, more preferably 3 mass % or more and 20 mass % or less, and still more preferably 3 mass % or more and 15 mass % or less, based on the entire binder resin, from the viewpoint of achieving both the low temperature fixability of the toner and the prevention of the gloss unevenness of the image.

The binder resin preferably contains an amorphous resin in addition to the crystalline resin.

Examples of the amorphous resin include vinyl-based resins obtained from a homopolymer of monomers such as styrenes (such as styrene, parachlorostyrene, and α-methylstyrene), (meth)acrylates (such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (such as acrylonitrile and methacrylonitrile), vinyl ethers (such as vinyl methyl ether and vinyl isobutyl ether), vinyl ketones (such as vinyl methyl ketone, vinyl ethyl ketone, and vinyl isopropenyl ketone), and olefins (such as ethylene, propylene, and butadiene), or a copolymer combining two or more of these monomers.

Examples of the amorphous resin also include non-vinyl-based resins such as an epoxy resin, a polyester resin, a polyurethane resin, a polyamide resin, a cellulose resin, a polyether resin, and a modified rosin, a mixture of these non-vinyl-based resins and the vinyl-based resins, or a graft polymer obtained by polymerizing a vinyl-based monomer in the coexistence of these non-vinyl-based resins.

Among these, the binder resin preferably contains an amorphous polyester resin as the amorphous resin.

The glass transition temperature (Tg) of the amorphous resin is preferably 50° C. or higher and 80° C. or lower, and more preferably 50° C. or higher and 65° C. or lower.

The glass transition temperature is obtained from a DSC curve obtained by differential scanning calorimetry (DSC), and is more specifically obtained by the "extrapolated glass transition onset temperature" described in JIS K 7121-1987 "Method for measuring glass transition temperature of plastics", which is a method for obtaining the glass transition temperature.

The "crystalline" of a resin refers to having a clear endothermic peak in differential scanning calorimetry (DSC), not a stepwise change in endothermic amount, and specifically refers to that the half-value width of the endothermic peak when measured at a temperature rising rate of 10 (° C./min) is within 10° C.

On the other hand, the "amorphous" of the resin refers to that the half-value width is larger than 10° C., that the endothermic amount changes stepwise, or that no clear endothermic peak is observed.

The binder resin preferably contains a crystalline polyester resin as the crystalline resin and an amorphous polyester resin as the amorphous resin.

Hereinafter, the crystalline polyester resin and the amorphous polyester resin will be described in detail as examples of the crystalline resin and the amorphous resin, respectively.

Amorphous Polyester Resin

Examples of the amorphous polyester resin include a polycondensate of a polycarboxylic acid and a polyhydric alcohol. As the amorphous polyester resin, a commercially available product or a synthesized product may be used.

Examples of the polycarboxylic acid include aliphatic dicarboxylic acids (such as oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acids (such as cyclohexanedicarboxylic acid), aromatic dicarboxylic acids (such as terephthalic acid, isophthalic acid, phthalic acid, and naphthalenedicarboxylic acid), and an anhydride or a lower alkyl ester (e.g., having 1 or more and 5 or less carbon atoms) thereof. Among these, the polycarboxylic acid is preferably, for example, an aromatic dicarboxylic acid.

As the polycarboxylic acid, a tricarboxylic acid or higher carboxylic acid having a cross-linked structure or a branched structure may be used in combination with a dicarboxylic acid. Examples of the tricarboxylic acid or higher carboxylic acid include trimellitic acid, pyromellitic acid, and an anhydride or a lower alkyl ester (e.g., having 1 or more and 5 or less carbon atoms) thereof.

The polycarboxylic acid may be used alone or in combination of two or more thereof.

Examples of the polyhydric alcohol include aliphatic diols (such as ethylene glycol, diethylene glycol, triethylene glycol, propylene glycol, butanediol, hexanediol, and neopentyl glycol), alicylic diols (such as cyclohexanediol, cyclohexanedimethanol, and hydrogenated bisphenol A), and aromatic diols (such as a bisphenol A ethylene oxide adduct and a bisphenol A propylene oxide adduct). Among these, the polyhydric alcohol is preferably, for example, an aromatic diol and an alicyclic diol, and more preferably an aromatic diol.

As the polyhydric alcohol, a trihydric alcohol or higher polyhydric alcohol having a cross-linked structure or a branched structure may be used in combination with a diol. Examples of the trihydric alcohol or higher polyhydric alcohol include glycerin, trimethylolpropane, and pentaerythritol.

The polyhydric alcohol may be used alone or in combination of two or more thereof.

The glass transition temperature (Tg) of the amorphous polyester resin is preferably 50° C. or higher and 80° C. or lower, and more preferably 50° C. or higher and 65° C. or lower.

The glass transition temperature is obtained from a DSC curve obtained by differential scanning calorimetry (DSC), and is more specifically obtained by the "extrapolated glass transition onset temperature" described in JIS K 7121:1987 "Method for measuring glass transition temperature of plastics", which is a method for obtaining the glass transition temperature.

The weight average molecular weight (Mw) of the amorphous polyester resin is preferably 5,000 or more and 1,000,000 or less, and more preferably 7,000 or more and 500,000 or less.

The number average molecular weight (Mn) of the amorphous polyester resin is preferably 2,000 or more and 100,000 or less.

The molecular weight distribution Mw/Mn of the amorphous polyester resin is preferably 1.5 or more and 100 or less, and more preferably 2 or more and 60 or less.

The weight average molecular weight and the number average molecular weight are measured by gel permeation chromatography (GPC). The molecular weight is measured by GPC by using a GPC HLC-8120GPC manufactured by Tosch Corporation as a measurement device, a column TSKgel Super HM-M (15 cm) manufactured by Tosoh Corporation, and a THF solvent. The weight average molecular weight and the number average molecular weight are calculated from the measurement result using a molecular weight calibration curve prepared using a monodispersed polystyrene standard sample.

The amorphous polyester resin is obtained by a well-known production method. Specifically, for example, the amorphous polyester resin may be obtained by a method in which the polymerization temperature is set to 180° C. or higher and 230° C. or lower, the pressure in the reaction system is reduced as necessary, and the reaction is performed while removing water and alcohol generated dining the condensation.

When raw material monomers are insoluble or incompatible at the reaction temperature, a high boiling point solvent may be added as a dissolution assisting agent for dissolution. In this case, the polycondensation reaction is carried out while distilling off the dissolution assisting agent. When there is a poorly compatible monomer in the copolymerization reaction, it is preferable that the poorly compatible monomer is firstly condensed with an acid or alcohol to be polycondensed with the poorly compatible monomer and then the obtained product is polycondensed with the main component.

Crystalline Polyester Resin

Examples of the crystalline polyester resin include a polycondensate of a polycarboxylic acid and a polyhydric alcohol. As the crystalline polyester resin, a commercially available product or a synthesized product may be used.

Here, in order to easily form a crystal structure, the crystalline polyester resin is preferably a polycondensate using a polymerizable monomer having a linear aliphatic group rather than a polymerizable monomer having an aromatic ring.

Examples of the polycarboxylic acid include aliphatic dicarboxylic acids (such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids such as phthalic acid, isophthalic acid, terephthalic acid, and naphthalene-2,6-dicarboxylic acid), and an anhydride or a lower alkyl ester (e.g., having 1 or more and 5 or less carbon atoms) thereof.

As the polycarboxylic acid, a tricarboxylic acid or higher carboxylic acid having a cross-linked structure or a branched structure may be used in combination with a dicarboxylic acid. Examples of the tricarboxylic acid include aromatic carboxylic acids (such as 1,2,3-benzenetricarboxylic acid, 1,2,4-benzenetricarboxylic acid, and 1,2,4-naphthalenetricarboxylic acid), and an anhydride or a lower alkyl ester (e.g., having 1 or more and 5 or less carbon atoms) thereof.

As the polycarboxylic acid, a dicarboxylic acid having a sulfonic acid group or a dicarboxylic acid having an ethylenic double bond may be used in combination with these dicarboxylic acids.

The polycarboxylic acid may be used alone or in combination of two or more thereof.

Examples of the polyhydric alcohol include aliphatic diols (such as a linear aliphatic dial having 7 or more and 20 or less carbon atoms in the main chain portion). Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these, the aliphatic dial is preferably 1,8-octanediol, 1,9-nonanediol, and 1,10-decanediol.

As the polyhydric alcohol, a trihydric alcohol or higher alcohol having a cross-linked structure or a branched structure may be used in combination with a diol. Examples of the trihydric alcohol or higher polyhydric alcohol include glycerin, trimethylolethane, trimethylolpropane, and pentaerythritol.

The polyhydric alcohol may be used alone or in combination of two or more thereof.

Here, the polyhydric alcohol preferably has an aliphatic diol content of 80 mol % or more, and preferably 90 mol % or more.

The melting temperature of the crystalline polyester resin is preferably 50° C. or higher and 100° C. or lower, more preferably 55° C. or higher and 90° C. or lower, and still more preferably 60° C. or higher and 85° C. or lower.

The melting temperature is obtained from the DSC curve obtained by differential scanning calorimetry (DSC) according to the "melting peak temperature" described in JIS K 7121:1987 "Method for measuring transition temperature of plastics", which is a method for obtaining the melting temperature.

The weight average molecular weight (Mw) of the crystalline polyester resin is preferably 6,000 or more and 35,000 or less.

The crystalline polyester resin may be obtained by a well-known production method, similar to the amorphous polyester resin.

The content of the binder resin is preferably 40 mass % or more and 95 mass % or less, more preferably 50 mass % or more and 90 mass % or less, and still more preferably 60 mass % or more and 85 mass % or less, based on the total toner particles.

—Colorant—

Examples of the colorant include: pigments such as Carbon Black, Chrome Yellow, Hansa Yellow, Benzidine Yellow, Slene Yellow. Quinoline Yellow, Pigment Yellow, Permanent Orange GTR, Pyrazolone Orange, Balkan Orange, Watch Young Red. Permanent Red, Brilliant Carmine 3B, Brilliant Carmine 6B, DuPont Oil Red, Pyrazolone Red, Resole Red, Rhodamine B Lake, Lake Red C, Pigment Red, Rose Bengal, Aniline Blue, Ultramarine Blue, Chalco oil Blue, Methylene Blue Chloride, Phthalocyanine Blue, Pigment Blue, Phthalocyanine Green, and Malachite Green Oxalate; and acridine, xanthene, azo, benzoquinone, azine, anthraquinone, thioindico, dioxazine, thiazine, azomethine, indico, phthalocyanine, aniline black, polymethine, triphenylmethane, diphenylmethane, and thiazole dyes.

The colorants may be used alone or in combination of two or more thereof.

As the colorant, a surface-treated colorant may be used as necessary, or the colorant may be used in combination with a dispersant. In addition, a plurality of types of colorants may be used in combination.

The content of the colorant is preferably 1 mass % or more and 30 mass % or less, and more preferably 3 mass % or more and 15 mass % or less, based on the total toner particles.

A half drop temperature of a flow tester of the toner is preferably 90° C. or higher and 140° C. or lower, more preferably 95° C. or higher and 120° C. or lower, and still more preferably 95° C. or higher and 115° C. or lower.

When the half drop temperature of the flow tester of the toner is 90° C. or higher and 140° C. or lower, the low temperature fixability of the toner is easily obtained. On the other hand, when the half drop temperature of the flow tester of the toner is 90° C. or higher and 140° C. or lower, the surface of the toner particles is likely to be soft, while the inclusion of the carrier prevents the embedding of the external additive and prevents gloss unevenness of the image.

The half drop temperature of the flow tester of the toner is measured with a Koka flow tester CFT-500C (manufactured by Shimadzu Corporation). Under conditions where the diameter of the fine pore of the die is 0.5 mm, the length of the fine pore of the die is 1 in, the pressure load is 0.98 MPa (10 kg/cm$^2$), the preheating time is 5 minutes, the temperature rising rate is 1° C. minute, the measurement temperature interval is 1° C., and the starting temperature is 65° C., a temperature corresponding to half of the height from the outflow start point to the end point when 1.1 g of the sample is melted and outflowed is defined as the half drop temperature of the flow tester of the toner.

As the colorant, an inorganic pigment containing a metal atom (hereinafter, also referred to as "metal-containing inorganic pigment") may be contained.

Since the toner particles containing the metal-containing inorganic pigment have a large specific gravity, collision energy during stirring in the developing unit is likely to be large. When low-density images are continuously formed, the toner in the developing unit is stirred together with the carrier for a long period of time with little replacement, so that the external additive is likely to be embedded in the surface of the toner particles. When the external additive is embedded in the surface of the toner particles, it is difficult to obtain the effect of improving the flowability of the toner due to the external additive, and the opportunity of contact between the toner particles increases, so that the flowability of the toner may decrease.

In addition, in a high-temperature and high-humidity environment (e.g., an environment of a temperature of 28.5° C. and a humidity of 85%), moisture adheres to the surface of the toner particles due to the influence of the polarization of the metal-containing inorganic pigment disposed near the surface of the toner particles. Therefore, the flowability of the toner may decrease due to the influence of the adhered moisture.

Further, when a developer containing the toner having decreased flowability is stored in the developing unit of the image forming apparatus and the image forming apparatus is started to operate after the toner is stored for a long period of time in a high-temperature and high-humidity environment (e.g., stored for 17 hours under an environment of a temperature of 40° C. and a humidity of 90%), the toner clogging may occur in the developing unit due to the toner aggregation. Specifically, for example, the toner clogging (so-called trimer clogging) may occur between a developer carrier and a layer regulating member in the developing unit. When the toner clogging occurs in the developing unit, an image in which color streaks are generated due to the toner clogging may be obtained.

In contrast, in the exemplary embodiment, fine irregularities are present on the carrier surface.

Therefore, it is considered that the fine irregularities on the carrier surface cause point contact with the toner and reduce the contact area, thereby alleviating the collision load due to the stirring and preventing the embedding of the external additive. In addition, it is considered that the moisture adhering to the surface of the toner particles is scraped off and retained by the fine irregularities on the carrier surface, thereby removing the bounded moisture on the surface of the toner particles.

Further, it is presumed that, with the prevention of the embedding of the external additive and the removal of the bounded moisture, the decrease in the flowability of the toner is prevented, and the toner clogging in the developing unit due to the toner aggregation when the image forming apparatus is started to operate after the toner is stored in a high-temperature and high-humidity environment for a long period of time is prevented; therefore, the generation of color streaks in images due to the toner clogging is prevented.

Examples of the metal-containing inorganic pigments include a white pigment and a bright pigment.

Examples of the white pigment include titanium oxide, aluminum hydroxide, satin white, talc, zinc oxide, magnesium oxide, magnesium carbonate, kaolin, aluminosilicate, sericite, and bentonite.

Examples of the bright pigment include: metal pigments such as aluminum, brass, bronze, nickel, stainless, and zinc; mica coated with titanium oxide, yellow iron oxide, or the like; flaky or plate-like crystals of aluminosilicate, basic carbonate, barium sulfate, titanium oxide, bismuth oxychloride, or the like; and flaky glass powder, flaky glass powder deposited with metals.

The average particle diameter of the metal-containing inorganic pigment is, for example, 150 nm or more, preferably 180 nm or more, and more preferably 200 nm or more. When the average particle diameter of the metal-containing inorganic pigment is 150 nm or more, a convex portion caused by the metal-containing inorganic pigment is likely to be formed on the surface of the toner particles, and the toner particles make point contact with other particles at the convex portion, thereby preventing the decrease in the flowability of the toner due to the embedding of the external additive.

The average particle diameter of the metal-containing inorganic pigment may be 500 nm or less, 450 nm or less, or 400 nm or less. When the average particle diameter of the metal-containing inorganic pigment is 500 nm or less, the structure controllability in the toner particles may be excellent.

The average particle diameter of the metal-containing inorganic pigment is preferably 150 nm or more and 500 nm or less, more preferably 180 nm or more and 450 nm or less, and still more preferably 200 nm or more and 400 nm or less.

When the metal-containing inorganic pigment is a bright pigment, the average particle diameter of the bright pigment may be 3 μm or more and 20 μm or less, 4.5 μm or more and 18 μm or less, or 6 μm or more and 16 μm or less.

The average particle diameter of the metal-containing inorganic pigment is determined by the same method as the average particle diameter of the inorganic particles contained in the resin layer of the carrier.

Specifically, the toner is embedded in an epoxy resin and cut with a microtome to prepare a cross section of the toner particles. An SEM image of the cross section of the toner particles taken by a scanning electron microscope (SEM) is taken into an image processing analysis device to perform image analysis. 100 metal-containing inorganic pigments (primary particles) in the toner particles are randomly selected, a circle-equivalent diameter (nm) of each particle is determined, and the circle-equivalent diameters are arithmetically averaged to obtain the average particle diameter (nm) of the metal-containing inorganic pigment. That is, the average particle diameter of the metal-containing inorganic pigment is a number average particle diameter.

The content of the metal-containing inorganic pigment may be 1 mass % or more, or 5 mass % or more, based on the total toner particles. The content of the metal-containing inorganic pigment is preferably 10 mass % or more, more preferably 25 mass % or more, and particularly preferably 32 mass % or more, based on the total toner particles. In particular, when the content of the metal-containing inorganic pigment is 10 mass % or more, the convex portion caused by the metal-containing inorganic pigment is likely to be formed on the surface of the toner particles, and the toner particles make point contact with other particles at the convex portion, thereby preventing the decrease in the flowability of the toner due to the embedding of the extremal additive.

The content of the metal-containing inorganic pigment may be 70 mass % or less, or 50 mass % or less, based on the total toner particles. In particular, when the content of the metal-containing inorganic pigment is 50 mass % or less, image fogging due to charge injection into the toner particles is prevented.

The content of the metal-containing inorganic pigment is preferably 10 mass % or more and 50 mass % or less, more preferably 25 mass % or more and 50 mass % or less, and still more preferably 32 mass % or more and 50 mass % or less.

The developer according to the exemplary embodiment may contain an electrostatic charge image developing toner which contains tuner particles containing an inorganic pigment containing a metal atom and contains an external additive adhered to a surface of the toner particles, and a carrier which contains magnetic particles and a resin layer coating the magnetic particles and containing inorganic particles, the carrier having an average particle diameter of the inorganic particles is 5 nm or more and 90 nm or less, an average thickness of the resin layer is 0.6 μm or more and 1.4 μm or less, and a ratio B/A of a surface area B of the carrier to a plan view area A of the carrier is 1.020 or more and 1.110 or less when a surface of the carrier is three-dimensionally analyzed.

—Release Agent—

Examples of the release agent include: hydrocarbon wax; natural wax such as carnauba wax, rice wax, and candelilla wax; synthetic wax or mineral or petroleum wax such as montan wax; and ester wax such as fatty acid ester and montanic acid ester. The release agent is not particularly limited thereto.

The melting temperature of the release agent is preferably 50° C. or higher and 110° C. or lower, and more preferably 60° C. or higher and 100° C. or lower.

The melting temperature is obtained from the DSC curve obtained by differential scanning calorimetry (DSC) according to the "melting peak temperature" described in JIS K 7121:1987 "Method for measuring transition temperature of plastics", which is a method for obtaining the melting temperature.

The content of the release agent is preferably 1 mass % or more and 20 mass % or less, and more preferably 5 mass % or more and 15 mass % or less, based on the total toner particles.

—Other Additives—

Examples of other additives include known additives such as magnetic materials, charge control agents, and inorganic powders. These additives are contained in the toner particles as internal additives.

—Characteristics of Toner Particles—

The toner particles may be toner particles having a single-layer structure, or so-called core-shell structure toner particles (core-shell type particles) composed of a core portion (core particles) and a coating layer (shell layer) for coating the core portion.

The core-shell structure toner particles preferably include, for example, a core portion containing a binder resin and, if necessary, other additives such as a colorant and a release agent, and a coating layer containing the binder resin.

The volume average particle diameter $D_{50v}$ of the toner particles is preferably 2 μm or more and 10 μm or less, and more preferably 4 μm or more and 8 μm or less.

The volume average particle diameter $D_{50v}$ of the toner particles is measured using a Coulter Multisizer II (manufactured by Beckman Coulter, Inc.) and the electrolytic solution is ISOTON-II (manufactured by Beckman Coulter, Inc.).

In the measurement, 0.5 mg or more and 50 mg or less of a measurement sample is added to 2 ml of a 5 mass % aqueous solution of a surfactant (preferably sodium alkylbenzenesulfonate) as a dispersant. The obtained mixture is added to 100 ml or more and 150 ml or less of the electrolytic solution.

The electrolytic solution in which the sample is suspended is subjected to a dispersion treatment for 1 minute with an ultrasonic disperser, and the Coulter Multisizer II is used to measure the particle diameter distribution of particles having a particle diameter in the range of 2 μm or more and 60 μm or less using an aperture having an aperture diameter of 100 μm. The number of the particles sampled is 50,000. With respect to the measured particle diameter, a cumulative distribution by volume drawn from the side of the small diameter, and the particle diameter corresponding to the cumulative percentage of 50% is defined as the volume average particle diameter $D_{50v}$.

The average circularity of the toner particles is preferably 0.94 or more and 1.00 or less, and more preferably 0.95 or more and 0.98 or less.

The average circularity of the toner particles is obtained according to (circle equivalent perimeter)/(perimeter), that is, (perimeter of circle having the same projected area as the particle image)/(perimeter of particle projection image). Specifically, the average circularity of the toner particles is a value measured by the following method.

First, the toner particles as measurement targets are suctioned and collected to form a flat flow, and flash light is emitted instantly to capture a particle image as a still image. The particle image is determined by a flow type particle image analyzer (FPIA-3000 manufactured by Sysmex Corporation) for image analysis. The number of the toner particles sampled for determining the average circularity is 3,500.

When the toner contains an external additive, the toner (developer) as a measurement target is dispersed in water containing a surfactant, then an ultrasonic treatment is performed to obtain toner particles from which the external additive has been removed.

When the metal-containing inorganic pigment is contained as the colorant, the area ratio of the convex portion on the surface of the toner particles caused by the metal-containing inorganic pigment is preferably 0.30% or more and 5.00% or less, more preferably 0.35% or more and 3.00% or less, and still more preferably 0.40% or more and 1.50% or less.

When the area ratio of the convex portion is 0.30% or more, the toner particles are likely to make point contact with other particles at the convex portion, thereby preventing the decrease in the flowability of the toner due to the embedding of the external additive. When the area ratio of the convex portion is 5.00% or less, image fogging due to charge injection into the toner particles is prevented.

The area ratio of the convex portion is controlled, for example, by adjusting the addition amount of the surfactant for use in the production process of the toner particles. When the toner particles have a core-shell structure, the area ratio of the convex portion may be controlled by adjusting the thickness of the shell layer.

The area ratio of the convex portion is, for example, calculated as follows.

SEM observation is performed with a high-resolution field emission scanning electron microscope (FE-SEM, model number: S-4700, manufactured by Hitachi High-Technologies Corporation) at an accelerating voltage of 6 kV using a measurement sample obtained by subjecting a toner as a measurement target to vapor deposition of platinum for 10 seconds by using a vapor deposition method. In age analysis is performed on the photograph of the surface of the obtained toner particles. The ratio (%) of the area of the convex portion caused by the metal-containing inorganic pigment to the area of the total toner particles is obtained for 100 toner particles, and the averaged value is defined as the "area ratio of the convex portion".

The average height of the convex portions caused by the metal-containing inorganic pigment on the surface of the toner particles is preferably 0.05 μm or more and 0.30 μm or less, more preferably 0.10 μm or more and 0.30 μm or less, and still more preferably 0.15 μm or more and 0.25 μm or less.

When the average height of the convex portions is 0.05 μm or more, the toner particles are likely to make point contact with other particles at the convex portion, thereby preventing the decrease in the flowability of the toner due to the embedding of the external additive. When the average height of the convex portions is 0.30 μm or less, image fogging due to charge injection into the toner particles is prevented.

The average height of the convex portions is controlled, for example, by adjusting the addition amount of the surfactant for use in the production process of the toner particles.

The average height of the convex portions is, for example, calculated as follows.

SEM observation is performed with an electron beam three-dimensional roughness analyzer (model number: ERA-8900FE, manufactured by Elionix Inc.) at an accelerating voltage of 2 kV using a measurement sample obtained by subjecting a toner as a measurement target to vapor deposition of platinum for 70 seconds by using a vapor deposition method. Image analysis is performed on the photograph of the surface of the obtained toner particles. The surface roughness of the surface of the toner particles including the convex portion caused by the metal-containing inorganic pigment is calculated for 100 toner particles according to JIS B 0601-2001, and the value obtained by averaging maximum heights Ry (μm) is defined as the "average height of the convex portions".

—Method for Producing Toner Particles—

The toner particles may be produced by either a dry production method (e.g., a kneading pulverization method) or a wet production method (e.g., an aggregation and coalescence method, a suspension polymerization method, and a dissolution suspension method). These production methods are not particularly limited and known production methods are adopted. Among these, the toner particles are preferably obtained by the aggregation and coalescence method.

Specifically, in the case of producing the toner particles by the aggregation and coalescence method, the toner particles are produced by, for example, a step of preparing a resin particle dispersion liquid in which binder resin particles are dispersed (resin particle dispersion liquid preparation step), a step of aggregating resin particles and if necessary other particles in the resin particle dispersion liquid or a dispersion liquid after mixing other particle dispersion liquids if necessary, to form aggregated particles (aggregated particle forming step), and a step of heating an aggregated particle dispersion liquid in which the aggregated particles are dispersed to fuse and coalesce the aggregated particles to form toner particles (fusion and coalesce step).

Hereinafter, the details of each step will be described.

In the following description, a method for obtaining toner particles containing a colorant and a release agent will be described, but the colorant and the release agent are used as necessary. Of course, other additives other than the colorant and the release agent may be used.

—Resin Particle Dispersion Liquid Preparation Step—

A colorant particle dispersion liquid in which colorant particles are dispersed and a release agent particle dispersion liquid in which release agent particles are dispersed are prepared together with a resin particle dispersion liquid in which binder resin particles are dispersed.

The resin particle dispersion liquid is prepared, for example, by dispersing resin particles in a dispersion medium with a surfactant.

Examples of the dispersion medium for use in the resin particle dispersion liquid include an aqueous medium.

Examples of the aqueous medium include water such as distilled water and ion-exchanged water, and alcohols. The aqueous medium may be used alone or in combination of two or more thereof.

Examples of the surfactant include: sulfate ester salt-based, sulfonate-based, phosphate ester-based, and soap-based anionic surfactants; amine salt-based and quaternary ammonium salt-based cationic surfactants; and polyethylene glycol-based, alkylphenol ethylene oxide adduct-based, and polyhydric alcohol-based nonionic surfactants. Among these, anionic surfactants and cationic surfactants are particularly preferred. The nonionic surfactant may be used in combination with an anionic surfactant or a cationic surfactant.

The surfactant may be used alone or in combination of two or more thereof.

For the resin particle dispersion liquid, examples of a method of dispersing the resin particles in the dispersion medium include general dispersion methods using a rotary shearing homogenizer, a ball mill having a media, a sand mill, and a dyno mill, or the like. Depending on the type of the resin particles, the resin particles may be dispersed in the dispersion medium by using a phase inversion emulsification method. The phase inversion emulsification method is a method of dispersing a resin in an aqueous medium in the form of particles by dissolving a resin to be dispersed in a hydrophobic organic solvent in which the resin is soluble, adding a base to the organic continuous phase (O phase) for neutralization, and then adding an aqueous medium (W phase) to change the phase from W/O to O/W.

The volume average particle diameter of the resin particles dispersing in the resin particle dispersion liquid is preferably, for example, 0.01 μm or more and 1 μm or less, more preferably 0.08 μm or more and 0.8 μm or less, and still more preferably 0.1 μm or more and 0.6 μm or less.

Regarding the volume average particle diameter of the resin particles, a cumulative distribution by volume is drawn from the side of the smallest diameter with respect to particle diameter ranges (so-called channels) separated using the particle diameter distribution obtained by the measurement of a laser diffraction-type particle diameter distribution measurement device (e.g., LA-700 manufactured by Horiba, Ltd.), and a particle diameter corresponding to the cumulative percentage of 50% with respect to the entire particles is set as a volume average particle diameter $D_{50v}$. The volume average particle diameter of the particles in other dispersion liquids is measured in the same manner.

The content of the resin particles contained in the resin particle dispersion liquid is preferably 5 mass % or more and 50 mass % or less, and more preferably 10 mass % or more and 40 mass % or less.

For example, the colorant particle dispersion liquid and the release agent particle dispersion liquid are prepared in the same manner as the resin particle dispersion liquid. That is, regarding the volume average particle diameter of particles, the dispersion medium, the dispersion method, and the content of the particles in the resin particle dispersion liquid, the same applies to the colorant particles dispersed in the colorant particle dispersion liquid and the release agent particles dispersed in the release agent particle dispersion liquid.

—Aggregated Particle Forming Step—

Next, the resin particle dispersion liquid, the colorant particle dispersion liquid, and the release agent particle dispersion liquid are mixed.

Then, in the mixed dispersion liquid, the resin particles, the colorant particles, and the release agent particles are hetero-aggregated to form aggregated particles containing the resin particles, the colorant particles, and the release agent particles, which have a diameter close to the diameter of the target toner particles.

Specifically, for example, an aggregating agent is added to the mixed dispersion liquid, the pH of the mixed dispersion liquid is adjusted to acidic (e.g., a pH of 2 or more and 5 or less), and a dispersion stabilizer is added if necessary. Then, the resin particles are heated to a temperature (specifically, for example, "the glass transition temperature of resin particles—30° C." or higher and "the glass transition temperature—10° C." or lower) close to the glass transition temperature to aggregate the particles dispersed in the mixed dispersion liquid, and thus the aggregated particles are formed.

In the aggregated particle forming step, for example, while stirring the mixed dispersion liquid with a rotary shear homogenizer, an aggregating agent is added at room temperature (e.g., 25° C.), the pH of the mixed dispersion liquid is adjusted to acidic (e.g., a pH of 2 or more and 5 or less), and a dispersion stabilizer is added if necessary. Then, the heating may be performed.

Examples of the aggregating agent include a surfactant having a polarity opposite to that of the surfactant contained in the mixed dispersion liquid, an inorganic metal salt, and a divalent or higher metal complex. When a metal complex is used as the aggregating agent, the amount of the surfactant used is reduced and the charging characteristics are improved.

If necessary, an additive that forms a complex or a similar bond with the metal ion of the aggregating agent may be used in combination with the aggregating agent. A chelating agent is preferably used as the additive.

Examples of the inorganic metal salt include: metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

A water-soluble chelating agent may be used as the chelating agent. Examples of the chelating agent include: oxycarboxylic acids such as tartaric acid, citric acid and gluconic acid; and aminocarboxylic acids such as iminodiacetic acid (IDA), nitrilotriacetic acid (NTA), and ethylenediaminetetraacetic acid (EDTA).

The amount of the chelating agent added is preferably 0.01 part by mass or more and 5.0 parts by mass or less, and more preferably 0.1 part by mass or more and less than 3.0 parts by mass, based on 100 parts by mass of the resin particles.

—Fusion and Coalesce Step—

Next, the aggregated particle dispersion liquid in which the aggregated particles are dispersed is heated to, for example, a temperature equal to or higher than the glass transition temperature of the resin particles (e.g., a temperature higher than the glass transition temperature of the resin particles by 10° C. to 30° C.) to fuse and coalesce the aggregated particles to form the toner particles.

After the above steps, the toner particles are obtained.

The toner particles may also be produced by a step of forming second aggregated particles by obtaining an aggregated particle dispersion liquid in which aggregated particles are dispersed, and then further nixing the aggregated particle dispersion liquid and a resin particle dispersion liquid in which resin particles are dispersed to further adhere and aggregate the resin particles to the surface of the aggregated particles, and a step of forming core-shell structure toner particles by heating a second aggregated particle dispersion liquid in which the second aggregated particles are dispersed to fuse and coalesce the second aggregated particles.

After the fusion and coalesce step, the toner particles formed in the solution are subjected to known washing step, solid-liquid separation step, and drying step to obtain dried toner particles. In the washing step, from the viewpoint of chargeability, it is preferable to sufficiently perform displacement washing with ion-exchanged water. In the solid-liquid separation step, suction filtration, pressure filtration or the like may be performed from the viewpoint of productivity. In the drying step, freeze-drying, air-flow drying, fluidized drying, vibration-type fluidized drying or the like may be performed from the viewpoint of productivity.

Then, the toner particles according to the exemplary embodiment are produced, for example, by adding an external additive to the obtained dried toner particles and mixing the two. The mixing may be performed by, for example, a V blender, a Henschel mixer, or a Loedige mixer. Further, if necessary, coarse particles in the toner may be removed using a vibration sieving machine, a wind sieving machine or the like.

—Extremal Additive—

Examples of the extremal additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO{\cdot}SiO_2$, $K_2O{\cdot}(TiO_2)_n$, $Al_2O_3{\cdot}2SiO_2$, $CaCO_3$, $MgCO_3$, $BaSO_4$, and $MgSO_4$.

The surface of the inorganic particles as an external additive is preferably subjected to a hydrophobic treatment. The hydrophobic treatment is performed, for example, by immersing the inorganic particles in a hydrophobic treatment agent. The hydrophobic treatment agent is not particularly limited, and examples thereof include a silane coupling agent, a silicone oil, a titanate coupling agent, and an aluminum coupling agent. The hydrophobic treatment agent may be used alone or in combination of two or more thereof.

The amount of the hydrophobic treatment agent is generally, for example, 1 part by mass or more and 10 parts by mass or less based on 100 parts by mass of the inorganic particles.

Examples of the external additive include resin particles (such as polystyrene, polymethylmethacrylate, and melamine resin), and cleaning activators (such as metal salts of higher fatty acids typified by zinc stearate, and particles of fluoropolymer).

The amount of the external additive is preferably 0.01 mass % or more and 5 mass % or less, and more preferably 0.01 mass % or more and 2.0 mass % or less, based on the toner particles.

<Image Forming Apparatus and Image Forming Method>

The image forming apparatus according to the exemplary embodiment includes: an image carrier; a charging unit for charging the surface of the image carrier; an electrostatic charge image forming unit for forming an electrostatic charge image on the surface of the charged image carrier; a developing unit for storing an electrostatic charge image developer and developing, as a toner image, the electrostatic charge image formed on the surface of the image carrier by using the electrostatic charge image developer; a transfer unit for transferring the toner image formed on the surface of the image carrier onto the surface of a recording medium; and a fixing unit for fixing the toner image transferred on the surface of the recording medium. Then, the electrostatic charge image developer according to the exemplary embodiment is applied as the electrostatic charge image developer.

In the image forming apparatus according to the exemplary embodiment, an image forming method (the image forming method according to the exemplary embodiment) is performed, which includes: a charging step of charging the surface of the image carrier; an electrostatic charge image forming step of forming an electrostatic charge image on the surface of the charged image carrier; a development step of developing, as a toner image, the electrostatic charge image formed on the surface of the image carrier by using the electrostatic charge image developer according to the exemplary embodiment; a transfer step of transferring the toner image formed on the surface of the image carrier onto the surface of the recording medium; and a fixing step of fixing the toner image transferred on the surface of the recording medium.

As the image forming apparatus according to the exemplary embodiment, known image forming apparatuses are applied, for example, a direct transfer type apparatus that directly transfers the toner image formed on the surface of the image carrier onto the recording medium, an intermediate transfer type apparatus that primarily transfers the toner image formed on the surface of the image carrier onto the surface of an intermediate transfer body, and secondarily transfers the toner image transferred on the surface of the intermediate transfer body onto the surface of the recording medium, an apparatus including a cleaning unit for cleaning the surface of the image carrier before the charging after the transfer of the toner image, and an apparatus including a charge removing unit for removing the charge by irradiating the surface of the image carrier before the charging with removing light after the transfer of the toner image.

When the image forming apparatus according to the exemplary embodiment is an intermediate transfer type apparatus, the transfer nit includes, for example, an intermediate transfer body with a toner image transferred onto the surface thereof, a primary transfer unit for primarily transferring the toner image formed on the surface of the image carrier onto the surface of the intermediate transfer body, and a secondary transfer unit for secondarily transferring the toner image transferred on the surface of the intermediate transfer body onto the surface of the recording medium.

In the image forming apparatus according to the exemplary embodiment, for example, a portion including the developing unit may have a cartridge structure (process cartridge) that is attached to and detached from the image forming apparatus. As the process cartridge, for example, a process cartridge including a developing unit for storing the electrostatic charge image developer according to the exemplary embodiment is preferably used.

Hereinafter, an example of the image forming apparatus according to the exemplary embodiment will be described, but the image forming apparatus is not limited thereto. In the following description, the main parts shown in the drawings will be described, and description of the other parts will be omitted.

FIG. 1 is a schematic configuration diagram illustrating the image forming apparatus according to the exemplary embodiment.

The image forming apparatus illustrated in FIG. 1 includes first to fourth electrophotographic image forming units 10Y, 10M, 10C, and 10K that output images of respective colors of yellow (Y), magenta (M), cyan (C), and black (K) based un image data subjected to color separation. These image forming units (hereinafter, may also be simply referred to as "units") 10Y, 10M, 10C, and 10K are arranged side by side in the horizontal direction with a predetermined distance therebetween. These units 10Y, 10M, 10C, and 10K may be process cartridges that are attached to and detached from the image forming apparatus.

Above the units 10Y, 10M, 10C, and 10K, an intermediate transfer belt 20 (an example of the intermediate transfer body) is extended through the units. The intermediate transfer belt 20 is provided around a drive roller 22 and a support roller 24, and is configured to run in the direction from the first unit 10Y to the fourth unit 10K. A force is applied to the support roller 24 in a direction away from the drive roller 22 by a spring or the like (not illustrated) and tension is applied to the intermediate transfer belt 20 wound around the support roller 24 and the drive roller 22. An intermediate transfer body cleaning device 30 is provided on an image carrier side surface of the intermediate transfer belt 20 so as to face the drive roller 22.

Developing devices 4Y, 4M, 4C, and 4K (an example of the developing unit) of the units 10Y, 10M, 10C, and 10K are supplied with yellow, magenta, cyan, and black toners stored in toner cartridges 8Y, 8M, 8C, and 8K, respectively.

Since the first to fourth units 10Y, 10M, 10C, and 10K have the same configuration and operation, here, the first unit 10Y, which is arranged on the upstream side in the running direction of the intermediate transfer belt and forms a yellow image, will be described as a representative.

The first unit 10Y includes a photoconductor 1Y functioning as an image carrier. Around the photoconductor 1Y, the following members are disposed in order: a charging roller 2Y (an example of the charging unit) for charging the surface of the photoconductor 1Y to a predetermined potential; an exposure device 3 (an example of the electrostatic charge image forming unit) for forming an electrostatic charge image by exposing the charged surface with a laser beam 3Y based on an image signal subjected to color separation; a developing device 4Y (an example of the developing unit) for developing the electrostatic charge image by supplying the charged toner to the electrostatic charge image; a primary transfer roller 5Y (an example of the primary transfer unit) for transferring the developed toner Image onto the intermediate transfer belt 20; and a photoconductor cleaning device 6Y (an example of the cleaning unit) for removing the toner remaining on the surface of the photoconductor 1Y after the primary transfer.

The primary transfer roller 5Y is disposed inside the intermediate transfer belt 20 and is provided at a position facing the photoconductor 1Y. A bias power source (not illustrated) for applying a primary transfer bias is connected to each of the primary transfer rollers 5Y, 5M, 5C, and 5K of the respective units. Each bias power source changes the value of the transfer bias applied to each primary transfer roller under the control of a controller (not illustrated).

Hereinafter, the operation of forming a yellow image in the first unit 10Y will be described.

First, prior to the operation, the surface of the photoconductor 1Y is charged to a potential of −600 V to −800 V by using the charging roller 2Y.

The photoconductor 1Y is formed by laminating a photoconductive layer on a conductive substrate (e.g., having volume resistivity at 20° C. of $1\times10^{-6}$ Ωcm or less). The photoconductive layer generally has high resistance (resistance of general resin), but, has a property that when irradiated with a laser beam, the specific resistance of the portion irradiated with the laser beam changes. Therefore, the exposure device 3 irradiates the charged surface of the photoconductor 1Y with the laser beam 3Y according to yellow image data sent from the controller (not illustrated). Accordingly, an electrostatic charge image having a yellow image pattern is formed on the surface of the photoconductor 1Y.

The electrostatic charge image is an image formed on the surface of the photoconductor 1Y by charging, and is a so-called negative latent image formed by lowering the specific resistance of the portion of the photoconductive layer irradiated with the laser beam 3Y to flow a charge charged on the surface of the photoconductor 1Y and by, on the other hand, leaving a charge of a portion not irradiated with the laser beam 3Y.

The electrostatic charge image formed on the photoconductor 1Y rotates to a predetermined developing position as the photoconductor 1Y runs. Then, at this developing position, the electrostatic charge image on the photoconductor 1Y is developed and visualized as a toner image by the developing device 4Y.

In the developing device 4Y, for example, an electrostatic charge image developer containing at least a yellow toner and a carrier is stored. The yellow toner is frictionally charged by being stirred in the developing device 4Y, and has a charge of the same polarity (negative) as the charge charged on the photoconductor 1Y and is carried on a developer roller (an example of a developer carrier). Then, when the surface of the photoconductor 1Y passes through the developing device 4Y, the yellow toner electrostatically adheres to a discharged latent image portion on the surface of the photoconductor 1Y, and the latent image is developed by the yellow toner. The photoconductor 1Y on which the yellow toner image is formed continues to run at a predetermined speed, and the toner image developed on the photoconductor 1Y is conveyed to a predetermined primary transfer position.

When the yellow toner image on the photoconductor 1Y is conveyed to the primary transfer position, a primary transfer bias is applied to the primary transfer roller 5Y, an electrostatic force from the photoconductor 1Y to the primary transfer roller 5Y acts on the toner image, and the toner image on the photoconductor 1Y is transfer-red onto the intermediate transfer belt 20. The transfer bias applied at this time has a polarity (+) opposite to the polarity (−) of the toner, and is controlled to, for example, +10 μA by the controller (not illustrated) in the first unit 10Y.

On the other hand, the toner remaining on the photoconductor 1Y is removed and collected by the photoconductor cleaning device 6Y.

The primary transfer bias applied to the primary transfer rollers 5M, 5C, and 5K at and after the second unit 10M is also controlled similar to the first unit.

In this way, the intermediate transfer belt 20 onto which the yellow toner image is transferred by the first unit JOY is sequentially conveyed through the second to fourth units 10M, 10C, and 10K, and the toner images of the respective colors are superimposed and transferred in a multiple manner.

The intermediate transfer belt 20 onto which the toner images of four colors are transferred in a multiple manner through the first to fourth units arrives at a secondary transfer unit including the intermediate transfer belt 20, the support roller 24 in contact with the inner surface of the intermediate transfer belt, and a secondary transfer roller 26 (an example of the secondary transfer unit) disposed on the image carrying surface side of the intermediate transfer belt 20. On the other hand, recording paper P (an example of the recording medium) is fed through a supply mechanism into a gap where the secondary transfer roller 26 and the intermediate transfer belt 20 are in contact with each other at a predetermined timing, and a secondary transfer bias is applied to the support roller 24. The transfer bias applied at this time has the same polarity (−) as the toner polarity (−). The electrostatic force from the intermediate transfer belt 20 to the recording paper P acts on the toner image, and the toner image on the intermediate transfer belt 20 is transferred onto the recording paper P. The secondary transfer bias at this time is determined according to the resistance detected by a resistance detection unit (not illustrated) for detecting the resistance of the secondary transfer unit, and is voltage-controlled.

Thereafter, the recording paper P is sent to a pressure contact portion (so-called nip portion) of a pair of fixing rollers in a fixing device 28 (an example of the fixing unit), the toner image is fixed on the recording paper P, and a fixed image is formed.

Examples of the recording paper P onto which the toner image is transferred include plain paper for use in electrophotographic copying machines and printers. As the recording medium, in addition to the recording paper P, an OHP sheet or the like may be used.

To further improve the smoothness of the image surface after fixing, the surface of the recording paper P is also preferably smooth. For example, coated paper obtained by coating the surface of plain paper with a resin or the like, art paper for printing, and the like are preferably used.

The recording paper P, on which the fixing of the color image is completed, is conveyed out toward a discharge unit, and a series of color image forming operations is completed.

<Process Cartridge>

The process cartridge according to the exemplary embodiment is a process cartridge which includes a developing unit for storing the electrostatic charge image developer according to the exemplary embodiment and for developing, as a toner image, the electrostatic charge image formed on the surface of the image carrier by using the electrostatic charge image developer, and which is attached to and detached from the image forming apparatus.

The process cartridge according to the exemplary embodiment is not limited to the above configuration and may be configured to include a developing unit and, if necessary, at least one selected from other units such as an image carrier, a charging unit, an electrostatic charge image forming unit, and a transfer unit.

Hereinafter, an example of the process cartridge according to the exemplary embodiment will be shown, but the process cartridge is not limited thereto. In the following description, the main parts shown in the drawings will be described, and description of the other parts will be omitted.

FIG. 2 is a schematic configuration diagram illustrating the process cartridge according to the exemplary embodiment. A process cartridge 200 illustrated in FIG. 2 is configured as a cartridge by, for example, integrally combining and holding a photoconductor 107 (an example of the image carrier), a charging roller 108 (an example of the charging unit) provided around the photoconductor 107, a developing device 111 (an example of the developing unit), and a photoconductor cleaning device 113 (an example of the cleaning unit) by a housing 117 provided with a mounting rail 116 and an opening 118 for exposure.

In FIG. 2, 109 denotes an exposure device (an example of the electrostatic charge image forming unit), 112 denotes a transfer device (an example of the transfer unit), 115 denotes a fixing device (an example of the fixing unit), and 300 denotes recording paper (an example of the recording medium).

EXAMPLES

Hereinafter, the exemplary embodiment of the invention will be described in detail with reference to Examples, but the exemplary embodiment of the invention is not limited to these Examples. In the following description, the "parts" and "%" are based on mass unless otherwise specified.

In the following description, the volume average particle diameter means a particle diameter $D_{50v}$ corresponding to the cumulative percentage of 50% in a particle diameter distribution by volume drawn from the side of the small diameter.

<Preparation of Toner>

[Preparation of Amorphous Polyester Resin Dispersion Liquid (A1)]

Ethylene glycol: 37 parts
Neopentyl glycol: 65 parts
1,9-nonanediol: 32 parts
Terephthalic acid: 96 parts The above materials are charged into a flask, the temperature is raised to 200° C. over 1 hour, and after confirming that the reaction system is uniformly stirred, 1.2 parts of dibutyltin oxide is charged thereto. While distilling off the produced water, the temperature is raised to 240° C. over 6 hours and stirring is continued at 240° C. for 4 hours, to obtain an amorphous polyester resin (acid value: 9.4 mg KOH/g, weight average molecular weight: 13,000, glass transition temperature: 62° C.). The amorphous polyester resin in the molten state is transported to an emulsifying disperser (Cavitron CD1010, manufactured by Eurotech Corporation) at a rate of 100 g/min. Separately, dilute ammonia water having a concentration of 0.37%, obtained by diluting reagent ammonia water with ion-exchanged water, is charged into a tank, and transported to the emulsifying disperser at the same time as the amorphous polyester resin at a rate of 0.1 l/min, while being heated to 120° C. with a heat exchanger. The emulsifying disperser is operated under the conditions of a rotor rotation speed of 60 Hz and a pressure of 5 kg/cm$^2$ to obtain an amorphous polyester resin dispersion liquid (A1) having a volume average particle diameter of 160 nm and a solid content of 20%.

[Preparation of Crystalline Polyester Resin Dispersion Liquid (C1)]

Decanedioic acid: 81 parts
Hexanediol: 47 parts

The above materials are charged into a flask, the temperature is raised to 160° C. over 1 hour, and after confirming that the reaction system is uniformly stirred, 0.03 part of dibutyltin oxide is charged thereto. While distilling off the produced water, the temperature is raised to 200° C. over 6 hours and stirring is continued at 200° C. for 4 hours. Then, the reaction liquid is cooled and subjected to solid-liquid separation, and the solid is dried at a temperature of 40° C. under reduced pressure, to obtain a crystalline polyester resin (C1) (melting point: 64° C., weight average molecular weight: 15,000).

Crystalline polyester resin (C1): 50 parts
Anionic surfactant (Neogen RK manufactured by DIS Co. Ltd.): 2 parts
Ion-exchanged water: 200 parts The above materials are heated to 120° C. and dispersed using a homogenizer (Ultra Turrax T50, manufactured by IKA Company), and then a dispersion treatment is performed using a pressure discharge homogenizer. When the volume average particle diameter reached 180 nm, the particles are collected to obtain a crystalline polyester resin dispersion liquid (C1) having a solid content of 20%.

[Preparation of Release Agent Particle Dispersion Liquid (W1)]

Paraffin wax (HNP-9 manufactured by Nippon Seiro Co., Ltd.): 100 parts
Anionic surfactant (Neogen RK manufactured by DKS Co. Ltd.): 1 part
Ion-exchanged water: 350 parts The above materials are mixed, heated to 100° C., and dispersed using a homogenizer (Ultra Turrax T50, manufactured by IKA Company), and then a dispersion treatment is performed using a pressure discharge Gaulin homogenizer, to obtain a release agent particle dispersion liquid in which release agent particles having a volume average particle diameter of 200 nm are dispersed. Ion-exchanged water is added to the release agent particle dispersion liquid to adjust the solid content to 20% to obtain a release agent particle dispersion liquid (W1).

[Preparation of Colorant Particle Dispersion Liquid (K1)]

Carbon black (Regal 330 manufactured by Cabot Corporation): 50 parts
Anionic surfactant (Neogen RK manufactured by DKS Co. Ltd.): 5 parts
Ion-exchanged water: 195 parts The above materials are mixed and subjected to a dispersion treatment for 60 minutes using a high-pressure impact disperser (Ultimizer HJP30006, manufactured by Sugino Machine Co., Ltd.), to obtain a colorant particle dispersion liquid (K1) having a solid content of 20%.

[Preparation of Colorant Particle Dispersion Liquid (C1)]

Cyan pigment (Pigment Blue 15:3 manufactured by Dainichiseika Color & Chemicals Mfg. Co., Ltd.): 50 parts
Anionic surfactant (Neogen R manufactured by DKS Co. Ltd.): 5 parts
Ion-exchanged water: 195 parts The above materials are mixed and subjected to a dispersion treatment for 60 minutes using a high-pressure impact disperser (Ultimizer HJP30006, manufactured by Sugino Machine Co., Ltd.), to obtain a colorant particle dispersion liquid (C1) having a solid content of 20%.

[Preparation of Colorant Particle Dispersion Liquid (M1)]

Magenta pigment (Pigment Red 122 manufactured by DIC CORPORATION): 50 parts
Anionic surfactant (Neogen RK manufactured by DKS Co. Ltd.): 5 parts
Ion-exchanged water: 195 parts The above materials are mixed and subjected to a dispersion treatment for 60 minutes using a high-pressure impact disperser (Ultimizer HJP30006, manufactured by Sugino Machine Co., Ltd.), to obtain a colorant particle dispersion liquid (M1) having a solid content of 20%.

[Preparation of Black Toner Particles (K1)]

Ion-exchanged water: 200 parts
Amorphous polyester resin dispersion liquid (A1): 150 parts
Crystalline polyester resin dispersion liquid (C1): 10 parts
Release agent particle dispersion liquid (W1): 10 parts
Colorant particle dispersion liquid (K1): 15 parts
Anionic surfactant (TaycaPower): 2.8 parts The above materials are charged into a round stainless steel flask, 0.1 N nitric acid is added to adjust the pH to 3.5, and then a polyaluminum chloride aqueous solution prepared by dissolving 2 parts of polyaluminum chloride (manufactured by Oji Paper Company, 30% powder) in 30 parts of ion-exchanged water is added thereto. The mixture is dispersed at 30° C. using a homogenizer (Ultra Turrax T50, manufactured by IKA Company), and then heated to 45° C. in a heating oil bath and kept until the volume average particle diameter becomes 4.9 μm. Then, 60 parts of the amorphous polyester resin dispersion liquid (A1) is added and held for 30 minutes. Then, when the volume average particle diameter reaches 5.2 μm, 60 parts of the amorphous polyester resin dispersion liquid (A1) is further added and held for 30 minutes. Subsequently, 20 parts of 10% NTA (nitrilotriacetate) metal salt aqueous solution (CHIREST 70, manufactured by CHIREST Corporation) is added, and a 1 N sodium hydroxide aqueous solution is added to adjust the pH to 9.0. Then, 1 part of an anionic surfactant (TaycaPower) is charged thereto, and the mixture is heated to 85°

C. and held for 5 hours while continuing stirring. Then, the mixture is cooled to 20° C. at a rate of 20° C./min. Then, the mixture is filtered, washed thoroughly with ion-exchanged water, and dried, to obtain black toner particles (K1) having a volume average particle diameter of 5.7 μm and an average circularity of 0.971.

[Preparation of Cyan Toner Particles (C1)]

Cyan toner particles (C1) are obtained in the same manner as the preparation of the black toner particles (K1), except that the colorant particle dispersion liquid (K1) is changed to the colorant particle dispersion liquid (C1).

[Preparation of Magenta Toner Particles (M1)]

Magenta tonier particles (M1) are obtained in the same manner as the preparation of the black toner particles (K1), except that the colorant particle dispersion liquid (K1) is changed to the colorant particle dispersion liquid (M1).

[Preparation of Black Toner (K1)]

100 parts by mass of the black toner particles (K1) and 1.5 parts by mass of hydrophobic silica particles (RY50, manufactured by Nippon Aerosil Co., Ltd.) are charged into a sample mill and mixed at a rotation speed of 10,000 rpm for 30 seconds. Then, the mixture is sieved with a vibrating sieve having an opening of 45 μm to obtain a black toner (K1) having a volume average particle diameter of 5.7 μm.

[Preparation of Cyan Toner (C1)]

A cyan toner (C1) is obtained in the same manner as the preparation of the black toner (K1), except that the black toner particles (K1) are changed to the cyan toner particles (C1).

[Preparation of Magenta Toner (M1)]

A magenta toner (M1) is obtained in the same manner as the preparation of the black toner (K1), except that the black toner particles (K1) are changed to the magenta toner particles (M1).

<Preparation of Ferrite Particles>

1318 parts of $Fe_2O_2$, 587 parts of $Mn(OH)_2$, and 96 parts of $Mg(OH)_2$ are mixed and calcined at a temperature of 900° C. for 4 hours. The calcinated product, 6.6 parts of polyvinyl alcohol, 0.5 part of polycarboxylic acid as a dispersant, and zirconia beads having a media diameter of 1 mm are charged into water, and the mixture is crushed and mixed by a sand mill, to obtain a dispersion liquid. The volume average particle diameter of the particles in the dispersion liquid is 1.5 μm.

The dispersion liquid is used as a raw material and granulated and dried with a spray dryer to obtain granules having a volume average particle diameter of 37 μm. Then, in an oxygen-nitrogen mixed atmosphere with an oxygen partial pressure of 1%, Main calcination is performed at a temperature of 1450° C. for 4 hours using an electric furnace, and then heating is performed at a temperature of 900° C. for 3 hours in the atmosphere to obtain calcined particles. The calcined particles are crushed and classified to obtain ferrite particles (1) having a volume average particle diameter of 35 μm. The arithmetic average height Ra according to JIS B0601:2001 of the roughness curve of the ferrite particles (1) is 0.6 μm.

<Preparation of Silica Particles to be Added to Carrier Resin Layer

[Silica Particles (1)]

Commercially available hydrophilic silica particles (finned silica particles, no surface treatment, volume average particle diameter: 40 nm) are prepared and used as silica particles (1).

[Silica Particles (2)]

Into a 1.5 L glass reaction vessel equipped with a stirrer, a dropping nozzle and a thermometer, 890 parts of methanol and 210 parts of 9.8% ammonia water are charged and mixed to obtain an alkali catalyst solution. The alkali catalyst solution is adjusted to 45° C., then, 550 parts of tetramethoxysilane and 140 parts of 7.6% ammonia water are simultaneously added dropwise over 450 minutes while stirring, to obtain a silica particle dispersion liquid (A). The silica particles in the silica particle dispersion liquid (A) had a volume average particle diameter of 4 nm and a volume particle diameter distribution index (square root of the ratio of the particle diameter distribution $D_{84v}$ corresponding to the cumulative percentage of 84% to the particle diameter $D_{16v}$ corresponding to the cumulative percentage of 16% in a particle diameter distribution by volume drawn from the side of the small diameter, that is, $(D_{84v}/D_{16v})^{1/2}$) of 1.2, 300 parts of the silica particle dispersion liquid (A) is charged into an autoclave equipped with a stirrer, and the stirrer is rotated at a rotation speed of 100 rpm. While continuing the rotation of the stirrer, liquefied carbon dioxide is injected into the autoclave from a carbon dioxide cylinder via a pump, the temperature inside the autoclave is raised with a heater, and the pressure is increased with the pump, to bring the inside of the autoclave to a supercritical state of 150° C. and 15 MPa. A pressure valve is operated to circulate supercritical carbon dioxide through the autoclave while keeping the inside of the autoclave at 15 MPa to remove methanol and water from the silica particle dispersion liquid (A). When the amount of carbon dioxide supplied into the autoclave reached 900 parts, the supply of carbon dioxide is stopped and powder of silica particles is obtained.

While continuing the rotation of the stirrer of the autoclave when keeping the inside of the autoclave at 150° C. and 15 MPa with the heater and the pump and maintaining the supercritical state of carbon dioxide, 50 parts of hexamethyldisilazane is injected into the autoclave by an entrainer pump based on 100 parts of the silica, particles, and the inside of the autoclave is heated to 180° C. and reacted for 20 minutes. Then, supercritical carbon dioxide is again circulated through the autoclave to remove excess hexamethyldisilazane. Then, stirring is stopped, the pressure valve is opened, the pressure in the autoclave is released to atmospheric pressure, and the temperature is lowered to room temperature (25° C.). Thus, silica particles (2) surface-treated with hexamethyldisilazane are obtained. The silica particles (2) had a volume average particle diameter of 4 nm and a number average particle diameter of 5 nm.

[Silica Particles (3)]

Silica particles (3) surface-treated with hexamethyldisilazane are obtained in the same manner as the preparation of the silica particles (2), except that the volume average particle diameter of the silica particles in the silica particle dispersion liquid is changed to 6 nm by increasing the dropping amounts of tetramethoxysilane and 7.6% ammonia water when preparing the silica particle dispersion liquid (A). The silica particles (3) had a volume average particle diameter of 7 nm.

[Silica Particles (4)]

Commercially available hydrophobic silica particles (fumed silica particles surface-treated with hexamethyldisilazane, product name: Reorosil HM20S manufactured by Tokuyama Corporation, volume average particle diameter: 12 nm) are prepared and used as silica particles (4).

[Silica Particles (5)]

Commercially available hydrophilic silica particles (fumed silica particles, no surface treatment, volume average particle diameter: 62 nm) are prepared and used as silica particles (5),

[Silica Particles (6)]

Commercially available hydrophobic silica particles (finned silica particles surface-treated with hexamethyldisilazane, volume average particle diameter: 88 nm) are prepared and used as silica particles (6),

[Silica Particles (7)]

Commercially available hydrophobic silica particles (finned silica particles surface-treated with hexamethyldisilazane, volume average particle diameter: 93 nm) re prepared and used as silica particles (7).

<Preparation of Coating Agent for Forming Carrier Resin Layer>

[Coating Agent (1)]

Perfluoropropylethyl methacrylate-methyl methacrylate copolymer (polymerization ratio based on mass: 30:70, weight average molecular weight: 19,000): 75 parts Cyclohexyl methacrylate resin (weight average molecular weight: 50,000): 9 parts Carbon black (VXC72 manufactured by Cabot Corporation): 0.5 part Silica particles (1): 20 parts Toluene: 250 parts Isopropyl alcohol: 50 parts The above materials and glass beads (diameter: 1 mm, the same amount as toluene) are charged into a sand mill and stirred at a rotation speed of 190 rpm for 30 minutes, to obtain a coating agent (1) having a solid content of 11%.

[Coating Agents (2) to (7)]

The coating agents (2) to (7) are obtained in the same manner as the preparation of the coating agent (1), except that the silica particles (1) are changed to the corresponding silica particles (2) to (7).

[Coating Agents (8) to (11)]

The coating agents (8) to (11) are obtained in the same manner as the preparation of the coating agent (1), except that the addition amount of the silica particles (1) is charged as follows.

Coating agent (8): 10 parts of silica particles (1)

Coating agent (9): 12 parts of silica particles (1)

Coating agent (10): 30 parts of silica particles (1)

Coating agent (11): 40 parts of silica particles (1)

[Coating Agent (12-1) and Coating Agent (12-2)]

—Coating Agent (12-1)—

Cyclohexyl methacrylate resin (weight average molecular weight: 50,000): 20 parts Polyisocyanate (Coronate L manufactured by Tosoh Corporation): 4 parts Carbon black (VXC72 manufactured by Cabot Corporation): 1 part Toluene: 425 parts Methanol: 50 parts The above materials and glass beads (diameter: 1 mm, the same amount as toluene) are charged into a sand mill and stirred at a rotation speed of 1,200 rpm for 30 minutes, to obtain a coating agent (12-1) having a solid content of 5%, —Coating Agent (12-2)—

Silica particles (4): 8 parts

Toluene: 92 parts

The above materials and glass beads (diameter: 1 mm, the same amount as toluene) are charged into a sand mill and stirred at a rotation speed of 1,200 rpm for 30 minutes, to obtain a coating agent (12-2) having a solid content of 8%.

<Preparation of Resin-coated Carrier>

[Carrier (1)]

1,000 parts of the ferrite particles (1) and 125 parts of the coating agent (1) are charged into a kneader and mixed at room temperature (25° C.) for 20 minutes. Then, the mixture is heated to 70° C. and dried under reduced pressure.

The dried product is cooled to room temperature (25° C.), 125 parts of the coating agent (1) is additionally added, and the mixture is mixed at room temperature (25° C.) for 20 minutes. Then, the mixture is heated to 70° C. and dried under reduced pressure.

Then, the dried product is taken out from the kneader, and the coarse powder is removed by sieving with a mesh having an opening of 75 μm to obtain a carrier (1).

[Carriers (2) to (7)]

Carriers (2) to (7) are obtained in the same manner as the preparation of the carrier (1), except that the mixing time after the additional addition of the coating agent (1) is changed as shown in Table 1.

[Carriers (8) to (13)]

Carriers (8) to (13) are obtained in the same manner as the preparation of the carrier (1), except that the coating agent (1) is changed to the corresponding coating agents (2) to (7).

[Carriers (14) to (19)]

Carriers (14) to (19) are obtained in the same manner as the p reparation of the carrier (1) except that the amount of additional coating agent (1) is changed as shown in Table 1.

[Carriers (20) to (23)]

Carriers (20) to (23) are obtained in the same manner as the preparation of the carrier (1), except that the coating agent (1) is changed to the corresponding coating agents (8) to (11).

[Carrier (24)]

100 parts of the ferrite particles (1) and 40 parts of the coating agent (12-1) are charged into a vacuum degassing kneader, the temperature is raised and the pressure is reduced while stirring, and the mixture is stirred for 30 minutes under an atmosphere of 90° C./−720 mHg and dried. The carrier thus taken out is coated with 10 parts of the coating agent (12-2) by a spray method, dried, and then left in an electric furnace at 150° C. for 1 hour for calcination. The coarse powder is removed by sieving with a mesh having an opening of 75 μm to obtain a carrier (24).

<Preparation of Developer>

The corresponding carriers (1) to (24) and the black toner (K1) are charged in a V blender at a mixing ratio of carrier:toner=100:10 (mass ratio) and stirred for 20 minutes, to obtain black developers (K1) to (C24)

Cyan developers (C1) to (C24) are obtained in the same manner as above, except that the black toner (K1) is changed to the cyan toner (C1).

Magenta developers (M1) to (M24) are obtained in the same manner as above, except that the black toner (K1) is changed to the magenta toner (M1).

Hereinafter, the developer (K1), the developer (C1) and the developer (M1) are collectively referred to as the developer (1). The same applies to the developers (2) to (24).

<Measurement of Average Particle Diameter of Silica Particles in Resin Layer>

The carrier is embedded in an epoxy resin and cut with a microtome to prepare a carrier cross section. An SEM image of the carrier cross section taken by a scanning transmission electron microscope (S-4100 manufactured by Hitachi, Ltd.) is taken into an image processing analysis device (Luzex AP manufactured by Nireco) to perform image analysis. 100 silica particles (primary particles) in the resin layer are randomly selected, a circle-equivalent diameter (nm) of each particle is determined, and the circle-equivalent diameters are arithmetically averaged to obtain the average particle diameter (nm) of the silica particles.

<Measurement of Average Thickness of Resin Layer>

The SEM image is taken into an image processing analysis device (Luzex AP manufactured by Nireco) to perform image analysis. The thickness (μm) of the resin layer is measured by randomly selecting 10 points per one particle of the carrier, 100 carriers are further measured, and the thicknesses are arithmetically averaged to obtain the average thickness (μm) of the resin layer.

<Carrier Surface Analysis>

As a device for three-dimensionally analyzing the surface of the carrier, an electron beam three-dimensional roughness analyzer ERA-8900FE manufactured by Elionix Inc. is used. The carrier surface analysis performed by ERA-8900FE is specifically performed as follows.

The surface of one carrier particle is enlarged to 5000 times, three-dimensional measurement is performed by taking 400 measurement points in the long side direction and 300 measurement points in the short side direction, and a region of 24 μm×18 μm is measured to obtain three-dimensional image data. For the three-dimensional image data, the limit wavelength of the spline filter is set to 12 μm to remove wavelengths having a period of 12 μm or more, and the cutoff value of the Gaussian high-pass filter is set to 2.0 μm to remove wavelengths having a period of 2.0 μm or more, so as to obtain three-dimensional roughness curve data. From the three-dimensional roughness curve data, the surface area B ($\mu m^2$) of a central region of 12 μm×12 μm (plan view area A=144 $\mu m^2$) is obtained to obtain the ratio B/A. The ratio B/A is calculated for 100 carriers and arithmetically averaged.

<Measurement of Silicon Element Concentration>

The carrier is used as a sample and analyzed by X-ray photoelectron spectroscopy (XPS) under the following conditions, and the silicon element concentration (atomic %) is determined from the peak intensity of each element.

XPS device: VersaProbeII, manufactured by ULVAC-PHI, INCORPORATED

Etching gun: argon gun

Accelerating voltage: 5 kV

Emission current: 20 mA

Sputter region: 2 mm×2 mm

Sputter rate: 3 in/min (in terms of $SiO_2$)

<Evaluation on Blowing-out of Toner>

A modified machine of an image forming apparatus DocuPrintColor3540 (manufactured by Fuji Xerox Co., Ltd.) is prepared, and the corresponding developers (1) to (24) are charged into a developing machine. The image forming apparatus is left under an environment of a temperature of 22.5° C. and a relative humidity of 50% for 24 hours. Under the environment of a temperature of 22.5° C. and a relative humidity of 50%, 100.000 black test charts with an image density of 1% are continuously output onto A6 size plain paper, and then 100,000 black test charts with an image density of 100% are continuously output onto A6 size plain paper. After the image formation, the inside of the image forming apparatus is visually observed and classified as follows.

A: No machine contamination caused by the toner is recognized.

B: Machine contamination caused by the toner is recognized to be thin in a small region.

C: Slight machine contamination caused by the toner is recognized, but is within the allowable range for actual use.

D: Machine contamination caused by the toner is clearly recognized and causes a problem in actual use.

<Evaluation on Transferability>

An image forming apparatus DocuPrintColor400 (manufactured by Fuji Xerox Co., Ltd.) is prepared, and the corresponding developers (1) to (24) are charged into a developing machine. The image forming apparatus is left under an environment of a temperature of 10° C. and a relative humidity of 15% for 24 hours. Under the environment of temperature of 10° C. and a relative humidity of 15%, 50,000 test charts with an image density of 1% (blue with a cyan density of 50% and a magenta density of 50%) are continuously output to A4 size embossed paper (Resac 66 manufactured by Tokushu Tokai Paper Co., Ltd.). During image formation, the fixing temperature is 190° C. and the fixing pressure is 4.0 $kg/cm^2$.

—Toner Scattering—

The backgrounds of the 10th image and the 50,000th image are observed using a magnifying glass with a 100-fold scale, and classified as follows.

G0: No toner scattering.

G1: Toner scattering, but no problem in actual use.

G2: Toner scattering and may cause problem in actual use.

G3: Toner scattering and problem in actual use.

—Color Difference—

The L* value, a* value, and b* value are measured at 3 points on each of the 10th image and the 50,000th image by using a spectrophotometer (X-Rite Ci62, manufactured by X-Rite Inc.). The color difference ΔE is calculated based on the following equation, and the color difference ΔE is classified as follows.

$$\Delta E = \sqrt{(L_1 - L_2)^2 + (a_1 - a_2)^2 + (b_1 - b_2)^2}$$

In the equation, $L_1$, $a_1$ and $b_1$ are the L* value, the a* value and the b* value of the 10th image (the average value at the 3 points), and $L_2$, $a_2$, and $b_2$ are the L* value, the a* value, and the b* value of the 50,000th image (the average value at the 3 points).

G0: Color difference ΔE is 1 or less.

G1: Color difference ΔE is more than 1 and 3 or less.

G2: Color difference ΔE is more than 3 and 5 or less.

G3: Color difference ΔE is more than 5.

TABLE 1

| | | | Coating agent | | | Resin layer | | | | | Transferability | | |
|---|---|---|---|---|---|---|---|---|---|---|---|---|---|
| | Developer | Carrier | Type | Additional charging amount [part by mass] | Mixing time [min] after additional charging | Average particle diameter [nm] of silica particles | Average thickness [μm] | Ratio B/A | Silicon element concentration [atomic %] | Blowing-out of toner | Toner scattering of 10th image | Timer scattering of 50,000th image | Color difference ΔE |
| Comparative Example 1 | (2) | (2) | (1) | 125 | 40 | 40 | 1.0 | 1.019 | 10.1 | D | G0 | G3 | G3 |
| Example 1 | (3) | (3) | (1) | 125 | 37 | 40 | 0.9 | 1.022 | 10.8 | C | G0 | G2 | G2 |
| Example 2 | (4) | (4) | (1) | 125 | 30 | 40 | 1.2 | 1.043 | 10.2 | A | G0 | G1 | G1 |
| Example 3 | (1) | (1) | (1) | 125 | 20 | 40 | 0.9 | 1.065 | 11.0 | A | G0 | G0 | G0 |
| Example 4 | (5) | (5) | (1) | 125 | 16 | 40 | 1.0 | 1.077 | 12.0 | B | G0 | G0 | G1 |
| Example 5 | (6) | (6) | (1) | 125 | 10 | 40 | 1.1 | 1.098 | 11.5 | C | G1 | G2 | G2 |
| Comparative Example 2 | (7) | (7) | (1) | 125 | 5 | 40 | 1.1 | 1.103 | 10.9 | D | G3 | G3 | G3 |
| Comparative Example 3 | (8) | (8) | (2) | 125 | 20 | 4 | 1.1 | 1.067 | 11.9 | D | G1 | G2 | G2 |
| Example 6 | (9) | (9) | (3) | 125 | 20 | 7 | 0.8 | 1.055 | 11.1 | C | G1 | G2 | G2 |
| Example 7 | (10) | (10) | (4) | 125 | 20 | 12 | 0.8 | 1.078 | 9.8 | B | G1 | G1 | G1 |
| Example 8 | (11) | (11 | (5) | 125 | 20 | 62 | 1.3 | 1.056 | 10.8 | A | G1 | G2 | G2 |
| Example 9 | (12) | (12) | (6) | 125 | 20 | 88 | 0.8 | 1.042 | 10.6 | C | G2 | G2 | G1 |
| Comparative Example 4 | (13) | (13) | (7) | 125 | 20 | 93 | 0.7 | 1.059 | 10.0 | D | G2 | G2 | G1 |
| Comparntive Example 5 | (14) | (14) | (1) | 100 | 20 | 40 | 0.5 | 1.083 | 10.6 | D | G2 | G2 | G1 |
| Example 10 | (15) | (15) | (1) | 110 | 20 | 40 | 0.7 | 1.058 | 11.3 | C | G1 | G2 | G2 |
| Example 11 | (16) | (16) | (1) | 120 | 20 | 40 | 0.8 | 1.078 | 11.0 | B | G1 | G1 | G1 |
| Example 12 | (17) | (17) | (1) | 130 | 20 | 40 | 1.0 | 1.083 | 10.2 | A | G0 | G0 | G0 |
| Example 13 | (18) | (18) | (1) | 140 | 20 | 40 | 1.3 | 1.060 | 11.3 | C | G0 | G1 | G1 |
| Comparative Example 6 | (19) | (19) | (1) | 150 | 20 | 49 | 1.5 | 1.054 | 12.1 | D | G0 | G1 | G2 |
| Example 14 | (20) | (20) | (8) | 125 | 20 | 40 | 0.8 | 1.062 | 5.3 | B | G0 | G3 | G2 |
| Example 15 | (21) | (21) | (9) | 125 | 20 | 40 | 1.1 | 1.084 | 6.5 | A | G1 | G3 | G2 |
| Example 16 | (22) | (22) | (10) | 125 | 20 | 49 | 0.9 | 1.051 | 18.6 | A | G2 | G3 | G2 |
| Example 17 | (23) | (23) | (11) | 125 | 20 | 40 | 1.0 | 1.069 | 19.7 | B | G2 | G3 | G1 |
| Example 18 | (24) | (24) | (12-1) (12-2) | Prepared by spray method | | 12 | 1.0 | 1.050 | 10.0 | B | G0 | G0 | G0 |

<Examples in which Metal-Containing Inorganic Pigment is Contained as Colorant>

<Preparation of Colorant Particle Dispersion Liquid (W1)>

To 100 mL of 1 mol/L titanium tetrachloride aqueous solution, 0.15 mol of glycerin is added, the mixture is heated at 90° C. for 4 hours to form white particles, which is then filtered. The obtained white particles are dispersed in 100 mL of ion-exchanged water, 0.4 mol of hydrochloric acid is added thereto, and the mixture is heated again at 90° C. for 3 hours. The solution is adjusted to a pH of 7 with 0.1 N sodium hydroxide, filtrated, washed with water, and dried (105° C., 12 hours), to obtain white pigment particles (1) as particles of titanium dioxide. The obtained white pigment particles (1) have a particle diameter of 250 nm.

White pigment particles (1): 100 parts

Anionic surfactant (Neogen R manufactured by DKS Co. Ltd.): 15 parts

Ion-exchanged water: 400 parts

The above materials are mixed and dispersed for about 3 hours using a high-pressure impact disperser Ultimizer (HJP30006 manufactured by Sugino Machine Co., Ltd.), to obtain a colorant particle dispersion liquid (W1).

The solid content of the colorant particle dispersion liquid (W1) is 23 mass %.

<Preparation of Colorant Particle Dispersion Liquid (W2)>

To 100 mL of 1 mol/L titanium tetrachloride aqueous solution, 0.15 mol of glycerin is added, the mixture is heated at 25° C. for 1 hour to form white particles, which is then filtered. The obtained white particles are dispersed in 100 mL of ion-exchanged water, 0.4 mol of hydrochloric acid is added thereto, and the mixture is heated at 90° C. for 4 hours. The solution is adjusted to a pH of 7 with 0.1 N sodium hydroxide, filtrated, washed with water, and dried (105° C., 12 hours), to obtain white pigment particles (2) as particles of titanium dioxide. The obtained white pigment particles (2) have a particle diameter of 100 nm.

A colorant particle dispersion liquid (W2) is prepared in the same manner as the colorant particle dispersion liquid (W1), except that the white pigment particles (2) are used instead of the white pigment particles (1).

The solid content of the colorant particle dispersion liquid (W2) is 23 mass %.

<Preparation of Colorant Particle Dispersion Liquid (W3)>

To 100 mL of 1 mol/L titanium tetrachloride aqueous solution, 0.15 mol of glycerin is added, the mixture is heated at 95° C. for 7 hours to form white particles, which is then filtered. The obtained white particles are dispersed in 100 mL of ion-exchanged water, 0.4 mol of hydrochloric acid is added thereto, and the mixture is heated again at 95° C. for 4 hours. The solution is adjusted to a pH of 7 with 0.1 N sodium hydroxide, filtrated, washed with water, and dried (105° C., 12 hours), to obtain white pigment particles (3) as particles of titanium dioxide. The obtained white pigment particles (3) have a particle diameter of 750 nm.

A colorant particle dispersion liquid (W3) is prepared in the same manner as the colorant particle dispersion liquid (W1), except that the white pigment particles (3) are used instead of the white pigment particles (1).

The solid content of the colorant particle dispersion liquid (W3) is 23 mass %.

<Preparation of Toner Particles (W1)>

Ion-exchanged water: 200 parts

Amorphous polyester resin dispersion liquid (A1): 150 parts

Crystalline polyester resin dispersion liquid (C1): 10 parts

Release agent particle dispersion liquid (W1): 10 parts

Colorant particle dispersion liquid (W1): 20 parts

Anionic surfactant (TaycaPower): 2.8 parts

The above materials are charged into a round stainless steel flask, 0.1 N nitric acid is added to adjust the pH to 3.5, and then a polyaluminum chloride aqueous solution prepared by dissolving 2 parts of polyaluminum chloride (manufactured by Oji Paper Company, 30% powder) in 30 parts of ion-exchanged water is added thereto. The mixture is dispersed at 30° C. using a homogenizer (Ultra Turrax T50, manufactured by IKA Company), and then heated to 45° C. in a heating oil bath and kept until the volume average particle diameter becomes 4.9 μm.

Then, 60 parts of the amorphous polyester resin dispersion liquid (A1) is added and held for 30 minutes.

Then, when the volume average particle diameter reaches 5.2 μm, 60 parts of the amorphous polyester resin dispersion liquid (A1) is further added and held for 30 minutes.

Subsequently, 20 parts of 10% NTA (nitrilotriacetate) metal salt aqueous solution (CHIREST 70, manufactured by CHIREST Corporation) is added, and a 1 N sodium hydroxide aqueous solution is added to adjust the pH to 9.0. Then, 1 part of an anionic surfactant (TaycaPower) is charged thereto, and the mixture is heated to 85° C. and held for 5 hours while continuing stirring. Then, the mixture is cooled to 20° C. at a rate of 20° C./min. Then, the mixture is filtered, washed thoroughly with ion-exchanged water, and dried, to obtain toner particles (W1) having a volume average particle diameter of 5.7 μm and an average circularity of 0.971.

Hereinafter, the amorphous polyester resin dispersion liquid (A1) initially charged into the round stainless steel flask is also referred to as "initial amorphous polyester resin dispersion liquid (A1)", the amorphous polyester resin dispersion liquid (A1) added after holding until the volume average particle diameter becomes 4.9 μm is also referred to as "first additional amorphous polyester resin dispersion liquid (A1)", and the amorphous polyester resin dispersion liquid (A1) added when the volume average particle diameter is 5.2 μm is also referred to as "second additional amorphous polyester resin dispersion liquid (A1)".

<Preparation of Toner (W1)>

100 parts by mass of the toner particles (W1) and 1.5 parts by mass of hydrophobic silica particles (RY50, manufactured by Nippon Aerosil Co., Ltd.) are charged into a sample mill and mixed at a rotation speed of 10,000 rpm for 30 seconds. Then, the mixture is sieved with a vibrating sieve having an opening of 45 μm to obtain a toner (W1) having a volume average particle diameter of 5.7 μm.

<Preparation of Toner Particles (W2) and Toner (W2)>

Toner particles (W2) and a toner (W2) are obtained in the same manner as the toner particles (W1) and the toner (W1), except that the amount of the initial amorphous polyester resin dispersion liquid (A1) added is changed to 100 parts, the amount of the first additional amorphous polyester resin dispersion liquid (A1) added is changed to 90 parts, and the amount of the second additional amorphous polyester resin dispersion liquid (A1) added is changed to 80 parts.

<Preparation of Toner Particles (W3) and Toner (W3)>

Toner particles (W3) and a toner (W3) are obtained in the same manner as the toner particles (W1) and the toner (W1), except that the amount of the initial amorphous polyester resin dispersion liquid (A1) added is changed to 180 parts, the amount of the first additional amorphous polyester resin dispersion liquid (A1) added is changed to 60 parts, and the amount of the second additional amorphous polyester resin dispersion liquid (A1) added is changed to 30 parts.

<Preparation of Toner Particles (W4) and Toner (W4)>

Toner particles (W4) and a toner (W4) are obtained in the same manner as the toner particles (W1) and the toner (W1), except that the amount of the anionic surfactant (TaycaPower) added is changed to 1.9 parts.

<Preparation of Toner Particles (W5) and Toner (W5)>

Toner particles (W5) and a toner (W5) are obtained in the same manner as the toner particles (W1) and the toner (W1), except that the amount of the anionic surfactant (TaycaPower) added is changed to 3.5 parts.

<Preparation of Toner Particles (W6) and Toner (W6)>

Toner particles (W6) and a toner (W6) are obtained in the same manner as the toner particles (W1) and the toner (W1), except that the amount of the initial amorphous polyester resin dispersion liquid (A1) added is changed to 80 parts, the amount of the first additional amorphous polyester resin dispersion liquid (A1) added is changed to 100 parts, and the amount of the second additional amorphous polyester resin dispersion liquid (A1) added is changed to 90 parts.

<Preparation of Toner Particles (W7) and Toner (W7)>

Toner particles (W7) and a toner (W7) are obtained in the same manner as the toner particles (W1) and the toner (W1), except that the amount of the initial amorphous polyester resin dispersion liquid (A1) added is changed to 170 parts, the amount of the first additional amorphous polyester resin dispersion liquid (A1) added is changed to 90 parts, and the amount of the second additional amorphous polyester resin dispersion liquid (A1) added is changed to 10 parts.

<Preparation of Toner Particles (W8) and Toner (W8)>

Toner particles (W8) and a toner (W8) are obtained in the same manner as the toner particles (W1) and the toner (W1), except that 20 parts of the coolant particle dispersion liquid (W2) is added instead of 20 parts of the colorant particle dispersion liquid (W1) and the amount of the anionic surfactant (TaycaPower) added is changed to 1.5 parts.

<Preparation of Toner Particles (W9) and Toner (W9)>

Toner particles (W9) and a toner (W9) are obtained in the same manner as the toner particles (W1) and the toner (W1), except that 20 parts of the colorant particle dispersion liquid (W3) is added instead of 20 parts of the colorant particle dispersion liquid (W1) and the amount of the anionic surfactant (TaycaPower) added is changed to 4 parts.

<Preparation of Toner Particles (W10) and Toner (W10)>

Toner particles (W10) and a toner (W10) are obtained in the same manner as the toner particles (W1) and the toner (W1), except that 5.7 parts of the colorant particle dispersion liquid (W1) is added instead of 20 parts of the colorant particle dispersion liquid (W1) and the amount of the anionic surfactant (TaycaPower) added is changed from 2.8 parts to 1.4 parts.

<Preparation of Toner Particles (W11) and Toner (W11)>

Toner particles (W11) and a toner (W11) are obtained in the same manner as the toner particles (W1) and the toner (W1), except that 29 parts of the colorant particle dispersion liquid (W1) is added instead of 20 parts of the colorant particle dispersion liquid (W1).

<Preparation of Toner Particles (W12) and Toner (W12)>

Toner particles (W12) and a toner (W12) are obtained in the same manner as the toner particles (W1) and the toner (W1), except that 5 parts of the colorant particle dispersion liquid (W1) is added instead of 20 parts of the colorant particle dispersion liquid (W1).

<Preparation of Toner Particles (W13) and Toner (W13)>

Toner particles (W13) and a toner (W13) are obtained in the same manner as the toner particles (W1) and the toner (W1), except that 35 parts of the colorant particle dispersion liquid (W1) is added instead of 20 parts of the colorant particle dispersion liquid (W1).

<Measurement about Toner>

For the obtained toner, the area ratio of the convex portion caused by the white pigment on the surface of the toner particles ("convex portion ratio" in Table 2), the average particle diameter of the white pigment ("pigment particle diameter" in Table 2), the content of the white pigment based on the total toner particles ("pigment amount" in Table 2), and the average height of the convex portion caused by the white pigment on the surface of the toner particles ("convex portion height" in Table 2) are obtained by the above methods, and the results are shown in Table 2.

TABLE 2

| Toner | Convex portion ratio (%) | Pigment particle diameter (nm) | Pigment amount (mass %) | Convex portion height (μm) |
|---|---|---|---|---|
| W1 | 1.00 | 250 | 35 | 0.15 |
| W2 | 0.30 | 250 | 35 | 0.15 |
| W3 | 5.00 | 250 | 35 | 0.15 |
| W4 | 1.00 | 250 | 35 | 0.05 |
| W5 | 1.00 | 250 | 35 | 0.30 |
| W6 | 0.10 | 250 | 35 | 0.15 |
| W7 | 10.00 | 250 | 35 | 0.15 |
| W8 | 1.00 | 100 | 35 | 0.01 |
| W9 | 1.00 | 750 | 35 | 0.40 |
| W10 | 1.00 | 250 | 10 | 0.15 |
| W11 | 1.00 | 250 | 50 | 0.15 |
| W12 | 1.00 | 250 | 5 | 0.15 |
| W13 | 1.00 | 250 | 60 | 0.15 |

[Preparation of Carrier]

<Silica Particles (8)>

Silica particles (8) surface-treated with hexamethyldisilazane are obtained in the same manner as the preparation of the silica particles (2), except that the alkali catalyst solution is adjusted to 70° C., then the dropping amounts of tetramethoxysilane and 7.6% ammonia water are respectively changed to 550 parts of tetramethoxysilane and 100 parts of 7.6% ammonia water, the dropping time is changed to 400 minutes, and the number average particle diameter of the silica particles in the silica particle dispersion liquid is changed to 90 nm when preparing the silica particle dispersion liquid (A). The silica particles (8) have a number average particle diameter of 90 nm.

<Silica Particles (9)>

890 parts of methanol and 210 parts of 9.8% ammonia water are added into a 1.5 L glass reaction vessel equipped with a stirrer, a dropping nozzle and a thermometer, and mixed to obtain an alkali catalyst solution.

The alkali catalyst solution is adjusted to 47° C., then, 550 parts of tetramethoxysilane and 140 parts of 7.6% ammonia water are simultaneously added dropwise over 450 minutes while stirring, to obtain a hydrophilic silica particle dispersion liquid (B) having a particle diameter of 1 nm and a particle diameter distribution of 1.25.

Using the silica particle dispersion liquid (B), the silica particles are subjected to a surface treatment with a siloxane compound in a supercritical carbon dioxide atmosphere as described below. For the surface treatment, a device equipped with a carbon dioxide cylinder, a carbon dioxide pump, an entrainer pump, an autoclave with a stirrer (capacity 500 ml), and a pressure valve is used.

First, 300 parts of the silica particle dispersion liquid (B) is charged into the autoclave equipped with a stirrer (capacity 500 ml), and the stirrer is rotated at 100 rpm. Thereafter, liquefied carbon dioxide is injected into the autoclave, the temperature is raised with a heater, and the pressure is increased with a carbon dioxide pump, to bring the inside of the autoclave to a supercritical state of 150° C. and 15 MPa. While maintaining the inside of the autoclave at 15 MPa with the pressure valve, the supercritical carbon dioxide is circulated through the autoclave with the carbon dioxide pump to remove methanol and water from the silica particle dispersion liquid (B) (solvent removal step), to obtain silica particles (untreated silica particles).

Next, the circulation of supercritical carbon dioxide is stopped when the circulation amount of the supercritical carbon dioxide, which is an integrated amount measured as the circulation amount of carbon dioxide in the standard state, reaches 900 parts.

Thereafter, while maintaining the temperature of 150° C. with a heater and the pressure of 15 MPa with a carbon dioxide pump, and maintaining the supercritical state of carbon dioxide in the autoclave, with respect to 100 parts of the silica particles (untreated silica particles), 100 parts of hexamethyldisilazane (HMDS manufactured by Yuki Gosei Kogyo Co., Ltd.) as a hydrophobic treatment agent is previously injected into the autoclave by an entrainer pump, and then the substances are reacted at 180° C. for 20 minutes while stirring. Thereafter, the supercritical carbon dioxide is circulated again to remove the excess treatment agent solution. Thereafter, stirring is stopped, the pressure valve is opened, the pressure in the autoclave is released to atmospheric pressure, and the temperature is lowered to room temperature (25° C.). In this way, the solvent removal step and the surface treatment with a siloxane compound are sequentially performed to obtain silica particles (9) as surface-treated silica particles having a number average particle diameter of 1 nm.

<Silica Particles (10)>

Commercially available hydrophobic silica particles (silica particles surface-treated with hexamethyldisilazane, manufactured by CABOT, product number: TG-6020N, number average particle diameter 200: nm) are prepared as silica particles (10).

<Preparation of Carrier (25)>

Ferrite particles (1): 100 parts

Cyclohexyl methacrylate-methyl methacrylate copolymer (copolymerization ratio: 95 mol:5 mol): 3 parts Silica particles (4): 0.7 part Toluene: 14 parts Among the above materials, the cyclohexyl methacrylate-methyl methacrylate copolymer, the silica particles (1), toluene, and glass beads (diameter: 1 mm, the same amount as toluene) are charged into a sand mill (manufactured by Kansai Paint Co., Ltd.) and stirred at a rotation speed of 1.200 rpm for 30 minutes, to obtain a coating agent (13). Into a vacuum degassing kneader, the ferrite particles (1) is charged, further the coating agent (13) is charged, and the temperature is raised and the pressure is reduced over 30 minutes while stirring at 40 rpm. Then, toluene is distilled off, and the ferrite particles (1) are coated with a resin to form a resin layer. Next, fine powder and coarse powder are removed by an elbow jet to obtain a carrier (25) as a resin-coated carrier.

<Preparation of Carrier (26)>

A carrier (26) is obtained in the same manner as the carrier (25), except that the temperature rising and pressure reducing time is changed to 60 minutes.

<Preparation of Carrier (27)>

A carrier (27) is obtained in the same manner as the carrier (25), except that the temperature rising and pressure reducing time is changed to 15 minutes.

<Preparation of Carrier (28)>

A carrier (28) is obtained in the same manner as the carrier (25), except that 0.7 part of the silica particles (2) are used instead of 0.7 part of the silica particles (4), and the amount of the cyclohexyl methacrylate-methyl methacrylate copolymer added is changed to 3.4 parts.

<Preparation of Carrier (29)>

A carrier (29) is obtained in the same manner as the carrier (25), except that 0.7 part of the silica particles (8) are used instead of 0.7 part of the silica particles (4), and the amount of the cyclohexyl methacrylate-methyl methacrylate copolymer added is changed to 2 parts.

<Preparation of Carrier (30)>

A carrier (30) is obtained in the same manner as the carrier (25), except that the temperature rising and pressure reducing time is changed to 90 minutes.

<Preparation of Carrier (31)>

A carrier (31) is obtained in the same manner as the carrier (25), except that the temperature rising and pressure reducing time is changed to 10 minutes.

<Preparation of Carrier (32)>

A carrier (32) is obtained in the same manner as the carrier (25), except that 0.7 part of the silica particles (9) are used instead of 0.7 part of the silica particles (4), the temperature rising and pressure reducing time is changed to 45 minutes, and the amount of the cyclohexyl methacrylate-methyl methacrylate copolymer added is changed to 3 parts.

<Preparation of Carrier (33)>

A carrier (33) is obtained in the same manner as the carrier (25), except that 0.7 part of the silica particles (10) are used instead of 0.7 part of the silica particles (4).

<Preparation of Carrier (34)>

A carrier (34) is obtained in the same manner as the carrier (25), except that the amount of the cyclohexyl methacrylate-methyl methacrylate copolymer added is changed to 5 parts.

<Preparation of Carrier (35)>

A carrier (35) is obtained in the same manner as the carrier (25), except that the amount of the cyclohexyl methacrylate-methyl methacrylate copolymer added is changed to 1.3 parts.

<Preparation of Carrier (36)>

A carrier (36) is obtained in the same manner as the carrier (25), except that the silica particles (4) are not used.

<Measurement about Carrier>

For the obtained carrier, the ratio B/A ("ratio B/A" in Table 3 and Table 4), the average particle diameter of the silica particles contained in the resin layer ("particle diameter of inorganic particles" in Table 3 and Table 4), and the average thickness of the resin layer ("film thickness" in Table 3 and Table 4) are obtained by the above methods, and the results are shown in Table 3 and Table 4.

[Preparation of Developer]

The carriers shown in Table 3 and Table 4 and the toners shown in Table 3 and Table 4 are charged into a V blender at a mixing ratio of carrier:toner=100:10 (mass ratio) and stirred for 20 minutes to obtain white developers.

[Evaluation on Developer]

Under an environment of a temperature of 28.5° C. and a humidity of 85%, using a modified machine of an image forming apparatus DocuCentreColor400 (manufactured by Fuji Xerox Co., Ltd.), and using A4 size color paper (manufactured by Fuji Xerox Co., Ltd., light blue basis weight: 64 g/m), a test for outputting 100,000 images over 10 days is performed using an image sample in which a rectangular patch is written to have an image density of 20%. After outputting a total of 100,000 images, the modified machine is shut down and left for one day (specifically, left for 17 hours under an environment of a temperature of 40° C. and a humidity of 90%). Thereafter, 7,000 images are printed in one day using an image sample in which rectangular patches are written to have an image density of 20% in a borderless print mode. Then again, the modified machine is shut down and left for one day (specifically, left for 17 hours under an environment of a temperature of 40° C. and a humidity of 90%). On the next day, Test Chart No. 5 of the Imaging Society of Japan is output to evaluate the image quality (specifically, the color streak and the fogging are evaluated). The evaluation criteria for each evaluation are as follows, and the results are shown in Table 3 and Table 4. For the evaluation, the allowable range is up to C.

<Evaluation Criteria of Color Streak>

A: There is no problem in image quality.

B: With visual confirmation, slight unevenness due to the developing brush is observed on the developing sleeve, but there is no problem in image quality.

C: With visual confirmation, unevenness due to the developing brush is observed on the developing sleeve, and slight color streaks are observed.

D: With visual confirmation, unevenness due to the developing brush is observed on the developing sleeve, and clear color streaks are observed.

<Evaluation Criteria of Fogging>

A: The density E of the background portion (that is, non-image portion) of the image is less than 0.015, fogging is not visually observed, and fogging is not confirmed on the photoconductor in a tape transfer test, and there is no problem in image quality.

B: The density E of the background portion of the image is 0.015 or more and less than 0.03, fogging is not visually observed, and slight fogging is confirmed on the photoconductor in the tape transfer test, but there is no problem in image quality.

B−: The density E of the background portion of the image is 0.03 or more and less than 0.04, fogging is not visually observed, and fogging is confirmed on the photoconductor in the tape transfer test, but there is no problem in image quality.

C: The density E of the background portion of the image is 0.04 or more and less than 0.05, fogging is not visually observed, and fogging is clearly confirmed on the photoconductor in the tape transfer test, but the image quality is in an allowable range.

D: The density E of the background portion of the image is 0.05 or more, fogging is visually observed, and clear density unevenness is observed on the image.

The "density E" is an average value of the densities obtained by measuring 9 points in the non-image portion with an image densitometer (X-Rite 938 manufactured by X-Rite Inc.).

TABLE 3

| | | Carrier | | | | Evaluation | |
|---|---|---|---|---|---|---|---|
| Example | Toner No. | No. | Ratio B/A | Particle diameter (nm) of inorganic particles | Film thickness (μm) | Color streak | Fogging |
| Example 19 | W1 | 25 | 1.040 | 12 | 1.0 | A | A |

TABLE 3-continued

| Example | Toner No. | Carrier No. | Carrier Ratio B/A | Carrier Particle diameter (nm) of inorganic particles | Film thickness (μm) | Evaluation Color streak | Evaluation Fogging |
|---|---|---|---|---|---|---|---|
| Example 20 | W2 | 25 | 1.040 | 12 | 1.0 | B | B |
| Example 21 | W3 | 25 | 1.040 | 12 | 1.0 | B | B |
| Example 22 | W4 | 25 | 1.040 | 12 | 1.0 | B | B |
| Example 23 | W5 | 25 | 1.040 | 12 | 1.0 | B | B– |
| Example 24 | W1 | 26 | 1.020 | 12 | 1.0 | C | B |
| Example 25 | W1 | 27 | 1.110 | 12 | 1.0 | C | B |
| Example 26 | W1 | 28 | 1.040 | 5 | 1.4 | C | B |
| Example 27 | W1 | 29 | 1.040 | 90 | 0.6 | C | B |
| Example 28 | W6 | 25 | 1.040 | 12 | 1.0 | C | B |
| Example 29 | W7 | 25 | 1.040 | 12 | 1.0 | B | C |
| Example 30 | W8 | 25 | 1.040 | 12 | 1.0 | C | B |

TABLE 4

| Example | Toner No. | Carrier No. | Carrier Ratio B/A | Carrier Particle diameter (nm) of inorganic particles | Film thickness (μm) | Evaluation Color streak | Evaluation Fogging |
|---|---|---|---|---|---|---|---|
| Example 31 | W9 | 25 | 1.040 | 12 | 1.0 | B | C |
| Example 32 | W10 | 25 | 1.040 | 12 | 1.0 | C | A |
| Example 33 | W11 | 25 | 1.040 | 12 | 1.0 | A | C |
| Example 34 | W12 | 25 | 1.040 | 12 | 1.0 | C | B |
| Example 35 | W13 | 25 | 1.040 | 12 | 1.0 | C | D |
| Comparative Example 7 | W1 | 30 | 1.010 | 12 | 1.0 | D | B |
| Comparative Example 8 | W1 | 31 | 1.140 | 12 | 1.0 | D | B |
| Comparative Example 9 | W1 | 32 | 1.030 | 1 | 1.0 | D | B |
| Comparative Example 10 | W1 | 33 | 1.080 | 200 | 0.6 | D | C |
| Comparative Example 11 | W1 | 34 | 1.040 | 12 | 1.6 | D | C |
| Comparative Example 12 | W1 | 35 | 1.040 | 12 | 0.5 | D | C |
| Comparative Example 13 | W12 | 36 | 1.010 | — | 1.0 | D | B |

As shown in the above tables, it may be seen that the occurrence of color streaks in the image is prevented in Examples as compared with Comparative Examples.

<Examples in which Crystalline Resin is Used as Binder Resin>

<Preparation of Crystalline Polyester Resin Dispersion Liquid (C2)>

Decanedioic acid: 81 parts

Hexanediol: 47 parts

The above materials are charged into a flask, the temperature is raised to 160° C. over 1 hour, and after confirming that the reaction system is uniformly stirred, 0.03 part of dibutyltin oxide is charged thereto. While distilling off the produced water, the temperature is raised to 200° C. over 6 hours and stirring is continued at 200° C. for 4 hours. Then, the reaction liquid is cooled and subjected to solid-liquid separation, and the solid is dried at a temperature of 40° C. under reduced pressure, to obtain a crystalline polyester resin (C2) (melting point: 67° C., weight average molecular weight: 15,000).

A crystalline polyester resin dispersion liquid (C2) having a solid content of 20 mass % is obtained in the same manner as the crystalline polyester resin dispersion liquid (C1), except that the crystalline polyester resin (C2) is used instead of the crystalline polyester resin (C1).

<Preparation of Crystalline Polyester Resin Dispersion Liquid (C3)>

Dodecanedioic acid: 81 parts

Ethylene glycol: 47 parts

The above materials are charged into a flask, the temperature is raised to 160° C. over 1 hour, and after confirming that the reaction system is uniformly stirred, 0.03 part of dibutyltin oxide is charged thereto. While distilling off the produced water, the temperature is raised to 200° C. over 6 hours and stirring is continued at 200° C. for 4 hours. Then, the reaction liquid is cooled and subjected to solid-liquid separation, and the solid is dried at a temperature of 40° C. under reduced pressure, to obtain a crystalline polyester resin (C3) (melting point: 86° C., weight average molecular weight: 15,000).

A crystalline polyester resin dispersion liquid (C3) having a solid content of 20 mass % is obtained in the same manner as the crystalline polyester resin dispersion liquid (C1), except that the crystalline polyester resin (C3) is used instead of the crystalline polyester resin (C1).

<Preparation of Crystalline Polyester Resin Dispersion Liquid (C4)>

Octanedioic acid: 81 parts

Ethylene glycol: 47 parts

The above materials are charged into a flask, the temperature is raised to 160° C. over 1 hour, and after confirming that the reaction system is uniformly stirred, 0.03 part of dibutyltin oxide is charged thereto. While distilling off the produced water, the temperature is raised to 200° C. over 6 hours and stirring is continued at 200° C. for 4 hours. Then, the reaction liquid is cooled and subjected to solid-liquid separation, and the solid is dried at a temperature of 40° C. under reduced pressure, to obtain a crystalline polyester resin (C4) (melting point: 63° C., weight average molecular weight: 15,000).

A crystalline polyester resin dispersion liquid (C4) having a solid content of 20 mass % is obtained in the same manner as the crystalline polyester resin dispersion liquid (C1), except that the crystalline polyester resin (C4) is used instead of the crystalline polyester resin (C1).

<Preparation of Crystalline Polyester Resin Dispersion Liquid (C5)>

Phthalic acid: 81 parts

Nonanediol: 47 parts

The above materials are charged into a flask, the temperature is raised to 160° C. over 1 hour, and after confirming that the reaction system is uniformly stirred, 0.03 part of dibutyltin oxide is charged thereto. While distilling off the produced water, the temperature is raised to 200° C. over 6 hours and stirring is continued at 200° C. for 4 hours. Then, the reaction liquid is cooled and subjected to solid-liquid separation, and the solid is dried at a temperature of 40° C. under reduced pressure, to obtain a crystalline polyester resin (C5) (melting point: 91° C., weight average molecular weight: 15,000).

A crystalline polyester resin dispersion liquid (C5) having a solid content of 20 mass % is obtained in the same manner as the crystalline polyester resin dispersion liquid (C1), except that the crystalline polyester resin (C5) is used instead of the crystalline polyester resin (C1).

<Preparation of Black Toner Particles (K2)>

Ion-exchanged water: 200 pats

Amorphous polyester resin dispersion liquid (A1): 375 parts

Crystalline polyester resin dispersion liquid (C1): 50 parts
Release agent particle dispersion liquid (W1): 50 parts
Colorant particle dispersion liquid (K1): 25 parts
Anionic surfactant (TaycaPower): 2.8 parts The above materials are charged into a round stainless steel flask, 0.1 N nitric acid is added to adjust the pH to 3.5, and then a polyaluminum chloride aqueous solution prepared by dissolving 2 parts of polyaluminum chloride (manufactured by Oji Paper Company, 30% powder) in 30 parts of ion-exchanged water is added thereto. The mixture is dispersed at 30° C. using a homogenizer (Ultra Turrax T50, manufactured by IKA Company), and then heated to 45° C. in a heating oil bath and kept until the volume average particle diameter becomes 4.9 μm. Then, 60 parts of the amorphous polyester resin dispersion liquid (A1) is added and held for 30 minutes. Then, when the volume average particle diameter reaches 5.2 μm 60 parts of the amorphous polyester resin dispersion liquid (A1) is further added and held for 30 minutes. Subsequently, 20 parts of 10% NTA (nitrilotriacetate) metal salt aqueous solution (CHIREST 70, manufactured by CHIREST Corporation) is added, and a 1 N sodium hydroxide aqueous solution is added to adjust the pH to 9.0. Then, 1 part of an anionic surfactant (TaycaPower) is charged thereto, and the mixture is heated to 85° C. and held for 5 hours while continuing stirring. Then, the mixture is cooled to 20° C. at a rate of 20° C./min. Then, the mixture is filtered, washed thoroughly with ion-exchanged water, and dried, to obtain black toner particles (K2) having a volume average particle diameter of 5.7 μm and an average circularity of 0.971.

The content of the crystalline polyester resin (C1) based on the total black toner particles (K2) is 10 mass %.

<Preparation of Black Toner (K2)>

100 parts by mass of the black toner particles (K2) and 1.5 parts by mass of hydrophobic silica particles (external additive, RY50 manufactured by Nippon Aerosil Co., Ltd., average particle diameter: 40 nm) are charged into a sample mill and mixed at a rotation speed of 10,000 rpm for 30 seconds. Then, the mixture is sieved with a vibrating sieve having an opening of 45 μm to obtain a black toner (K2) having a volume average particle diameter of 5.7 μm. The half drop temperature of the flow tester is 105° C.

<Preparation of Black Toner Particles (K3) and Black Toner (K3)>

Black toner particles (K3) and a black toner (K3) are obtained in the same manner as the black toner particles (K2) and the black toner (K2), except that 75 parts of the crystalline polyester resin dispersion liquid (C2) is added instead of 10 parts of the crystalline polyester resin dispersion liquid (C1).

The content of the crystalline polyester resin (C2) based on the total black toner particles (K3) is 14.3 mass %. The half drop temperature of the flow tester is 95° C.

<Preparation of Black Toner Particles (K4) and Black Toner (K4)>

Black toner particles (K4) and a black toner (K4) are obtained in the same manner as the black toner particles (K2) and the black toner (K2), except that 35 parts of the crystalline polyester resin dispersion liquid (C3) is added instead of 10 parts of the crystalline polyester resin dispersion liquid (C1).

The content of the crystalline polyester resin (C3) based on the total black toner particles (K4) is 7.2 mass %. The half drop temperature of the flow tester is 135° C.

<Preparation of Black Toner Particles (K5) and Black Toner (K5)>

Black toner particles (K5) and a black toner (K5) are obtained in the same manner as the black toner particles (K2) and the black toner (K2), except that 125 parts of the crystalline polyester resin dispersion liquid (C4) is added instead of 10 parts of the crystalline polyester resin dispersion liquid (C1).

The content of the crystalline polyester resin (C4) based on the total black toner particles (K5) is 21.7 mass %. The half drop temperature of the flow tester is 85° C.

<Preparation of Black Toner Particles (K6) and Black Toner (K6)>

Black toner particles (K6) and a black toner (K6) are obtained in the same manner as the black toner particles (K2) and the black toner (K2), except that 25 parts of the crystalline polyester resin dispersion liquid (C5) is added instead of 10 parts of the crystalline polyester resin dispersion liquid (C1).

The content of the crystalline polyester resin (C5) based on the total black toner particles (K6) is 5.2 mass %. The half drop temperature of the flow tester is 145° C.

<Silica Particles (11)>

Commercially available hydrophobic silica particles (vapor-phase silica particles surface-treated with dimethyl silicone oil, manufactured by Tokuyama Corporation, product name: PM09, average primary particle diameter: 60 nm) are prepared as silica particles (11).

<Silica Particles (12)>

Silica particles (12) surface-treated with hexamethyldisilazane is obtained in the same manner as the preparation of the silica particles (2), except that the temperature of the alkali catalyst solution is changed to 35° C. The silica particles (12) have an average primary particle diameter of 75 nm.

<Silica Particles (13)>

Commercially available hydrophobic silica particles (vapor-phase silica particles surface-treated with hexamethyldisilazane, manufactured by Evonik Japan, product name: RX50, average primary particle diameter: 85 nm) are prepared as silica particles (13).

<Silica Particles (14)>

Silica particles (14) surface-treated with hexamethyldisilazane is obtained in the same manner as the preparation of the silica particles (2), except that the temperature of the alkali catalyst solution is changed to 45° C. The silica particles (14) have an average primary particle diameter of 2 nm.

<Preparation of Carrier (37)>

Ferrite particles (1): 100 parts
Toluene: 10 parts
Styrene-methyl methacrylate copolymer (copolymerization ratio: 15 mol:85 mol): 0.8 part
Cyclohexyl methacrylate-methyl methacrylate copolymer (copolymerization ratio: 95 mol:5 mol): 0.8 part
Carbon black: 0.08 part
Silica particles (4): 0.9 part Among the above materials, the styrene-methyl methacrylate copolymer, the cyclohexyl methacrylate-methyl methacrylate copolymer, the silica particles (4), toluene, and glass beads (diameter: 1 mm, the same amount as toluene) are charged into a sand mill (manufactured by Kansai Paint Co., Ltd) and stirred at a rotation speed of 1,200 rpm for 30 minutes, to obtain a coating agent (14). Into a vacuum degassing kneader, the ferrite particles (1) is charged, further half amount of the coating agent (14) is charged, and the temperature is raised to 70° C. and held for 15 minutes while stirring at 40 rpm, hereafter, the pressure is reduced over 30 minutes to distill off toluene. Thereafter, the mixture is cooled to room temperature (25° C.), the remaining half amount of the coating agent (14) is added, and the temperature is raised to 70° C. and the mixture is mixed for 20 minutes while stirring at 40 rpm. Thereafter, the pressure is reduced over 30 minutes to distill off toluene. Next, fine powder and coarse powder are removed by an elbow jet to obtain a carrier (37) as a resin-coated carrier.

<Preparation of Carrier (38)>

A carrier (38) is obtained in the same manner as the carrier (37), except that 0.6 part of the silica particles (13) are used instead of 0.9 part of the silica particles (4), the amount of the styrene-methyl methacrylate copolymer added is changed to 0.9 part, the amount of the cyclohexyl methacrylate-methyl methacrylate copolymer added is changed to 0.9 part, and the second mixing time (that is, the time to add the remaining half amount of the coating agent (14), and raise the temperature to 70° C. and mix the mixture while stirring at 4 rpm) is changed from 20 minutes to 40 minutes.

<Preparation of Carrier (39)>

A carrier (39) is obtained in the same manner as the carrier (37), except that 1.1 parts of the silica particles (2) are used instead of 0.9 part of the silica particles (4), the amount of the styrene-methyl methacrylate copolymer added is changed to 0.8 part, the amount of the cyclohexyl methacrylate-methyl methacrylate copolymer added is changed to 0.8 part, and the second mixing time (that is, the time to add the remaining half amount of the coating agent (14), and raise the temperature to 70° C. and mix the mixture while stirring at 40 rpm) is changed from 20 minutes to 15 minutes.

<Preparation of Carrier (40)>

A carrier (40) is obtained in the same manner as the carrier (37), except that 0.8 part of the silica particles (11) are used instead of 0.9 part of the silica particles (4), the amount of the styrene-methyl methacrylate copolymer added is changed to 0.9 part, the amount of the cyclohexyl methacrylate-methyl methacrylate copolymer added is changed to 0.9 part, and the second mixing time (that is, the time to add the remaining half amount of the coating agent (14), and raise the temperature to 70° C. and mix the mixture while stirring at 40 rpm) is changed from 20 minutes to 30 minutes.

<Preparation of Carrier (41)>

A carrier (41) is obtained in the same manner as the carrier (37), except that 1.0 part of the silica particles (12) are used instead of 0.9 part of the silica particles (4), the amount of the styrene-methyl methacrylate copolymer added is changed to 0.8 part, the amount of the cyclohexyl methacrylate-methyl methacrylate copolymer added is changed to 0.8 part and the second mixing time (that is, the time to add the remaining half amount of the coating agent (14), and raise the temperature to 70° C. and mix the mixture while stirring at 40 rpm) is changed from 20 minutes to 35 minutes.

<Preparation of Carrier (42)>

A carrier (42) is obtained in the same manner as the carrier (37), except that 0.4 part of the silica particles (4) are used instead of 0.9 part of the silica particles (4), the amount of the styrene-methyl methacrylate copolymer added is changed to 0.6 part, and the amount of the cyclohexyl methacrylate-methyl methacrylate copolymer added is changed to 0.6 part.

<Preparation of Carrier (43)>

A carrier (43) is obtained in the same manner as the carrier (37), except that 1.4 parts of the silica particles (4) are used instead of 0.9 part of the silica particles (4), the amount of the styrene-methyl methacrylate copolymer added is changed to 1.0 part, and the amount of the cyclohexyl methacrylate-methyl methacrylate copolymer added is changed to 1.0 part.

<Preparation of Carrier (44)>

A carrier (44) is obtained in the same manner as the carrier (37), except that 0.8 part of the silica particles (4) are used instead of 0.9 part of the silica particles (4), the amount of the styrene-methyl methacrylate copolymer added is changed to 0.7 part, and the amount of the cyclohexyl methacrylate-methyl methacrylate copolymer added is changed to 0.7 part.

<Preparation of Carrier (45)>

A carrier (45) is obtained in the same manner as the carrier (37), except that 1.1 parts of the silica particles (4) are used instead of 0.9 part of the silica particles (4), the amount of the styrene-methyl methacrylate copolymer added is changed to 0.9 part, and the amount of the cyclohexyl methacrylate-methyl methacrylate copolymer added is changed to 0.9 part.

<Preparation of Carrier (46)>

A carrier (46) is obtained in the same manner as the carrier (37), except that the silica particles (4) are not added, the amount of the styrene-methyl methacrylate copolymer added is changed to 1.1 parts, and the amount of the cyclohexyl methacrylate-methyl methacrylate copolymer added is changed to 1.1 parts.

<Preparation of Carrier (47)>

A carrier (47) is obtained in the sane manner as the carrier (37), except that 0.8 part of the silica particles (14) are used instead of 0.9 part of the silica particles (4), the amount of the styrene-methyl methacrylate copolymer added is changed to 0.8 part, the amount of the cyclohexyl methacrylate-methyl methacrylate copolymer added is changed to 0.8 part, and the second mixing tune (that is, the time to add the remaining half amount of the coating agent (14), and raise the temperature to 70° C. and mix the mixture while stirring at 40 rpm) is changed from 20 minutes to 10 minutes.

<Preparation of Carrier (48)>

A carrier (48) is obtained in the sane manner as the carrier (37), except that 0.2 part of the silica particles (4) are used instead of 0.9 part of the silica particles (4), the amount of the styrene-methyl methacrylate copolymer added is changed to 0.3 part, and the amount of the cyclohexyl methacrylate-methyl methacrylate copolymer added is changed to 0.3 part.

<Preparation of Carrier (49)>

A carrier (49) is obtained in the same manner as the carrier (37), except that 1.6 parts of the silica particles (4) are used instead of 0.9 part of the silica particles (4), the amount of the styrene-methyl methacrylate copolymer added is changed to 1.1 parts, and the amount of the cyclohexyl methacrylate-methyl methacrylate copolymer added is changed to 1.1 parts.

<Measurement about Carrier>

For the obtained carrier, the ratio B/A ("ratio B/A" in Table 5), the average particle diameter of the silica particles contained in the resin layer ("particle diameter of inorganic particles" in Table 5), and the average thickness of the resin layer ("film thickness" in Table 5) are obtained by the above methods, and the results are shown hi Table 5.

[Evaluation on Developer]

Under an environment of a temperature of 28.5° C. and a humidity of 85%, 10,000 halftone images with an image density of 10% are formed using a modified machine of an image forming apparatus DocuCentreColor400 (manufactured by Fuji Xerox Co., Ltd.), and using A4 size recording paper (manufactured by Fuji Xerox Co., Ltd., basis weight: 64 g/m$^2$). Then, an image with an image density of 100% is formed on thin A4 size recording paper (manufactured by Fuji Xerox Co., Ltd., ST paper, thickness: 78 μm, basis weight: 54 g/m$^2$) and 60 degree gloss is measured at 10 points using a gloss meter (BYK Micro-TRI-Gloss gloss meter (20+60+85°), manufactured by Gardner Inc.). The gloss unevenness is evaluated based on the difference in glossiness (maximum value−minimum value) and standard deviation at the 10 points. The evaluation criteria are as follows.

<Evaluation Criteria>

A: The gross difference is less than 5% and the standard deviation of 10 points in the gross measurement is 2 or less.

B: The gross difference is less than 5% and the standard deviation of 10 points in the gross measurement is more than 2.

C: The gross difference is 5% or more and less than 7.5%.

D: The gross difference is 7.5% or more and less than 10%.

E: The gross difference is 10% or more.

TABLE 5

| | Toner | | Carrier | | | | |
|---|---|---|---|---|---|---|---|
| | No. | Melting point (° C.) of crystalline resin | No. | Ratio B/A | Particle diameter (nm) of inorganic particles | Film thickness (μm) | Evaluation Gloss unevenness |
| Example 36 | K2 | 75 | 37 | 1.061 | 12 | 0.96 | A |
| Example 37 | K2 | 75 | 38 | 1.032 | 85 | 0.98 | C |
| Example 38 | K2 | 75 | 39 | 1.089 | 6 | 1.02 | C |
| Example 39 | K2 | 75 | 40 | 1.046 | 60 | 1.01 | B |
| Example 40 | K2 | 75 | 41 | 1.035 | 75 | 1.03 | B |
| Example 41 | K2 | 75 | 42 | 1.058 | 12 | 0.71 | C |
| Example 42 | K2 | 75 | 43 | 1.056 | 12 | 1.32 | C |
| Example 43 | K2 | 75 | 44. | 1.059 | 12 | 0.86 | B |
| Example 44 | K2 | 75 | 45 | 1.062 | 12 | 1.16 | B |
| Example 45 | K3 | 67 | 37 | 1.061 | 12 | 0.96 | C |
| Example 46 | K4 | 86 | 37 | 1.061 | 12 | 0.96 | C |
| Example 47 | K5 | 63 | 37 | 1.061 | 12 | 0.96 | D |
| Example 48 | K6 | 91 | 37 | 1.061 | 12 | 0.96 | D |
| Comparative Example 14 | K2 | 75 | 46 | 1.009 | — | 1.00 | E |
| Comparative Example 15 | K2 | 75 | 47 | 1.112 | 2 | 1.00 | E |
| Comparative Example 16 | K2 | 75 | 48 | 1.062 | 12 | 0.36 | E |
| Comparative Example 17 | K2 | 75 | 49 | 1.058 | 12 | 1.45 | E |

As shown in the above table, it may be seen that the gloss unevenness in the image is prevented in Examples as compared with Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the at to understand the invention for various embodiments and with the various modifications as are suited to the particular use contemplated. It is intended that the scope of the invention be defined by the following claims and their equivalents.

What is claimed is:

1. An electrostatic charge image developing carrier comprising:

magnetic particles; and an acrylate resin layer coating the magnetic particles and containing silica particles, wherein an average particle diameter of the silica particles is 5 nm or more and 90 nm or less, wherein an average thickness of the resin layer is 0.6 μm or more and 1.4 μm or less, and wherein a ratio B/A of a surface area B of the electrostatic charge image developing carrier to a plan view area A of the electrostatic charge image developing carrier is 1.020 or more and 1.100 or less when a surface of the electrostatic charge image developing carrier is three-dimensionally analyzed.

2. The electrostatic charge image developing carrier according to claim 1, wherein the ratio B/A is 1.040 or more and 1.080 or less.

3. The electrostatic charge image developing carrier according to claim 1, wherein the average particle diameter of the silica particles is 5 nm or more and 70 nm or less.

4. The electrostatic charge image developing carrier according to claim 1, wherein the average thickness of the resin layer is 0.8 μm or more and 1.2 μm or less.

5. The electrostatic charge image developing carrier according to claim 1, wherein a silicon element concentration on the surface of the electrostatic charge image developing carrier, determined by X-ray photoelectron spectroscopy, is more than 2 atomic % and less than 20 atomic %.

6. The electrostatic charge image developing carrier according to claim 5, wherein the silicon element concentration is more than 5 atomic % and less than 20 atomic %.

7. An electrostatic charge image developer comprising:

the electrostatic charge image developing carrier according to claim 1; and an electrostatic charge image developing toner.

8. The electrostatic charge image developer according to claim 7, wherein the electrostatic charge image developing toner contains:

toner particles containing an inorganic pigment containing a metal atom; and an external additive adhered to a surface of the toner particles, and wherein the ratio B/A is 1.020 or more and 1.110 or less.

9. The electrostatic charge image developer according to claim 8, wherein an average particle diameter of the inorganic pigment is 150 nm or more and 500 nm or less.

10. The electrostatic charge image developer according to claim 8, wherein an area ratio of convex portions caused by the inorganic pigment on the surface of the toner particles is 0.30% or more and 5.00% or less.

11. The electrostatic charge image developer according to claim 8, wherein an average height of the convex portions caused by the inorganic pigment on the surface of the toner particles is 0.05 μm or more and 0.30 μm or less.

12. The electrostatic charge image developer according to claim 7, wherein the electrostatic charge image developing toner contains toner particles containing a crystalline resin and contains an external additive adhered to a surface of the toner particles.

13. The electrostatic charge image developer according to claim 12, wherein a melting point of the crystalline resin is 65° C. or higher and 90° C. or lower.

14. The electrostatic charge image developer according to claim 12, wherein a content of the crystalline resin is 5 mass % or more and 30 mass % or less based on the total toner particles.

15. The electrostatic charge image developer according to claim 12, wherein a half drop temperature of a flow tester of the toner is 90° C. or higher and 140° C. or lower.

16. An image forming apparatus comprising:

an image carrier;

a charging unit configured to charge a surface of the image carrier;

an electrostatic charge image forming unit configured to form an electrostatic charge image on the surface of the charged image carrier;

a developing unit configured to develop the electrostatic charge image as a toner image by the electrostatic charge image developer according to claim 7;

a transfer unit configured to transfer the toner image onto a surface of a recording medium; and a fixing unit configured to fix the toner image on the surface of the recording medium.

* * * * *